US007093932B2

(12) United States Patent
Inokuchi et al.

(10) Patent No.: US 7,093,932 B2
(45) Date of Patent: Aug. 22, 2006

(54) INK-JET RECORDING DEVICE AND CONTROL METHOD THEREOF

(75) Inventors: Hidehiko Inokuchi, Ogori (JP); Yutaka Miyazono, Kasuga (JP); Kazuyuki Nakashima, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 22 days.

(21) Appl. No.: 10/359,821

(22) Filed: Feb. 6, 2003

(65) Prior Publication Data

US 2003/0151653 A1 Aug. 14, 2003

(30) Foreign Application Priority Data

Feb. 8, 2002 (JP) ..... P. 2002-032124
Feb. 14, 2002 (JP) ..... P. 2002-036505
Feb. 15, 2002 (JP) ..... P. 2002-038117

(51) Int. Cl.
*B41J 2/01* (2006.01)

(52) U.S. Cl. ..... 347/104; 400/88; 271/225

(58) Field of Classification Search ..... 347/104; 400/88, 606, 605; 271/225, 184, 902
See application file for complete search history.

(56) References Cited

U.S. PATENT DOCUMENTS 4,698,650 A 10/1987 Watanabe et al.
4,900,173 A * 2/1990 Okamura ..... 400/606
5,604,523 A * 2/1997 Tsukuda et al. ..... 347/86
5,746,526 A * 5/1998 Hirose ..... 400/619
5,896,143 A * 4/1999 Matsui et al. ..... 347/24
6,276,852 B1 8/2001 Osmus
6,296,407 B1 10/2001 McKay et al.
6,340,256 B1 1/2002 McKay et al.

FOREIGN PATENT DOCUMENTS

JP 60206688 A 10/1985
JP 07002380 * 1/1995
JP 2001-191613 7/2001
JP 2001-213019 8/2001
JP 2001-219620 8/2001

* cited by examiner

*Primary Examiner*—Stephen Meier
*Assistant Examiner*—Ly T. Tran
(74) *Attorney, Agent, or Firm*—Pearne & Gordon LLP

(57) ABSTRACT

A reference position of any size recording sheet P within a sheet feeding cassette is located on a front surface side.

13 Claims, 20 Drawing Sheets

INK-JET RECORDING DEVICE AND CONTROL METHOD THEREOF

BACKGROUND OF THE INVENTION

1. Field of the Invention

The present invention relates to an ink-jet recording device, and more particularly to an ink-jet recording device where necessary operations can be performed from a specific one direction.

2. Description of the Related Art

Recent use trend of the ink-jet recording device (printer) is that the recording device is connected not only to the computer but also to other kinds of devices, such a television and a VTR. There is a growing tendency for the printer installing location to change from the desktop to a family member gathering location, such as a living room. Under this circumstance, the printer is proposed which allows the user to make an access to the printer from the front side of the printer with the intention of loading of the ink cartridge, setting of recording sheets and taking out thereof, allowing for the need that the printer will be used stacked on other devices. A typical example of such is described in U.S. Pat. No. 6,276,852.

For techniques of low-profile printers, reference is made to U.S. Pat. Nos. 6,340,256; 6,296,407; and 4,698,650.

SUMMARY OF THE INVENTION

An object of the present invention is to provide an ink-jet recording device which is improved to have a further size reduction.

To achieve the above object, according to an ink-jet recording device of the present invention, a direction in which a recording medium is inserted into and drawn out of a device body and a direction in which a recorded recording medium is drawn out of a medium discharge portion are the same, and the direction is different from a transporting direction of the recording medium in a transporting system, wherein a surface through which the recording medium is inserted into and drawn out of the device body, and a surface through which the recorded recording medium is drawn out of the medium discharge portion are the same, and reference positions of the recording media in the medium feed portion are located closer to that surface.

In another ink-jet recording device, the maintenance unit is confronted with the recording head at an end of a reciprocatively moving region of the carriage located closer to a predetermined surface of the device.

In an ink-jet recording device, a transporting system for transporting a recording medium from the medium feed portion includes pickup roller for picking up a recording medium placed in the medium feed potion, and a U-turn roller for changing a transporting direction of the recording medium so as to invert a main component of a vector representing a transporting direction of the recording medium picked up by the pickup roller. In the transporting system, a bottom of the U-turn roller is located at a position which is lower than the pickup roller as viewed in the height direction.

DETAILED DESCRIPTION OF THE PREFERRED EMBODIMENT

Figure 1:
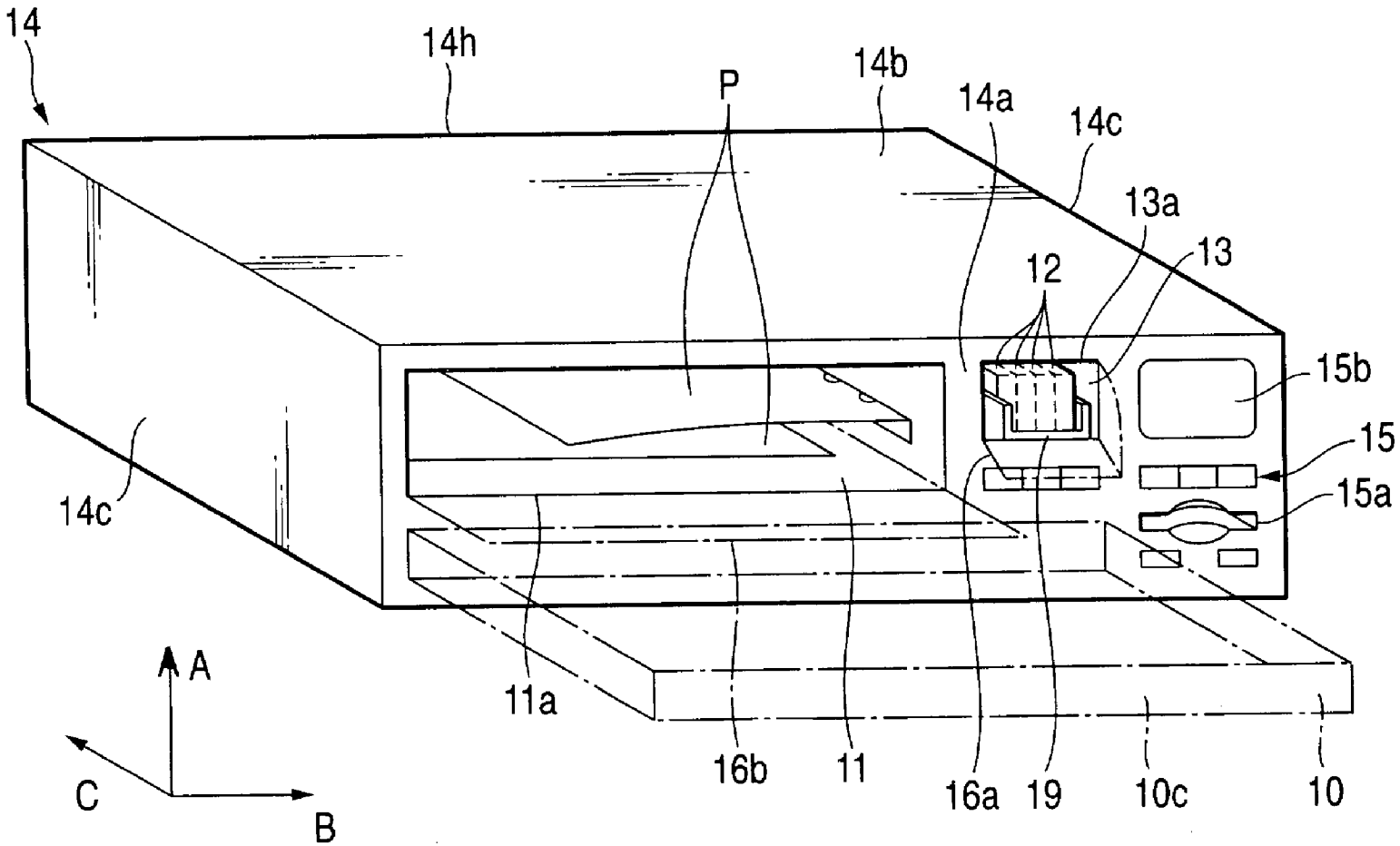
FIG. 1 is a front view perspectively showing an outward appearance of an ink-jet recording device according to a first embodiment of the invention.

Embodiments of the present invention will be described with reference to accompanying drawings. In the drawings, same reference numerals will be used for designating members, components, portions and others which have similar to or equivalent constructions and functions, for simplicity.

Embodiment 1

Figure 2:
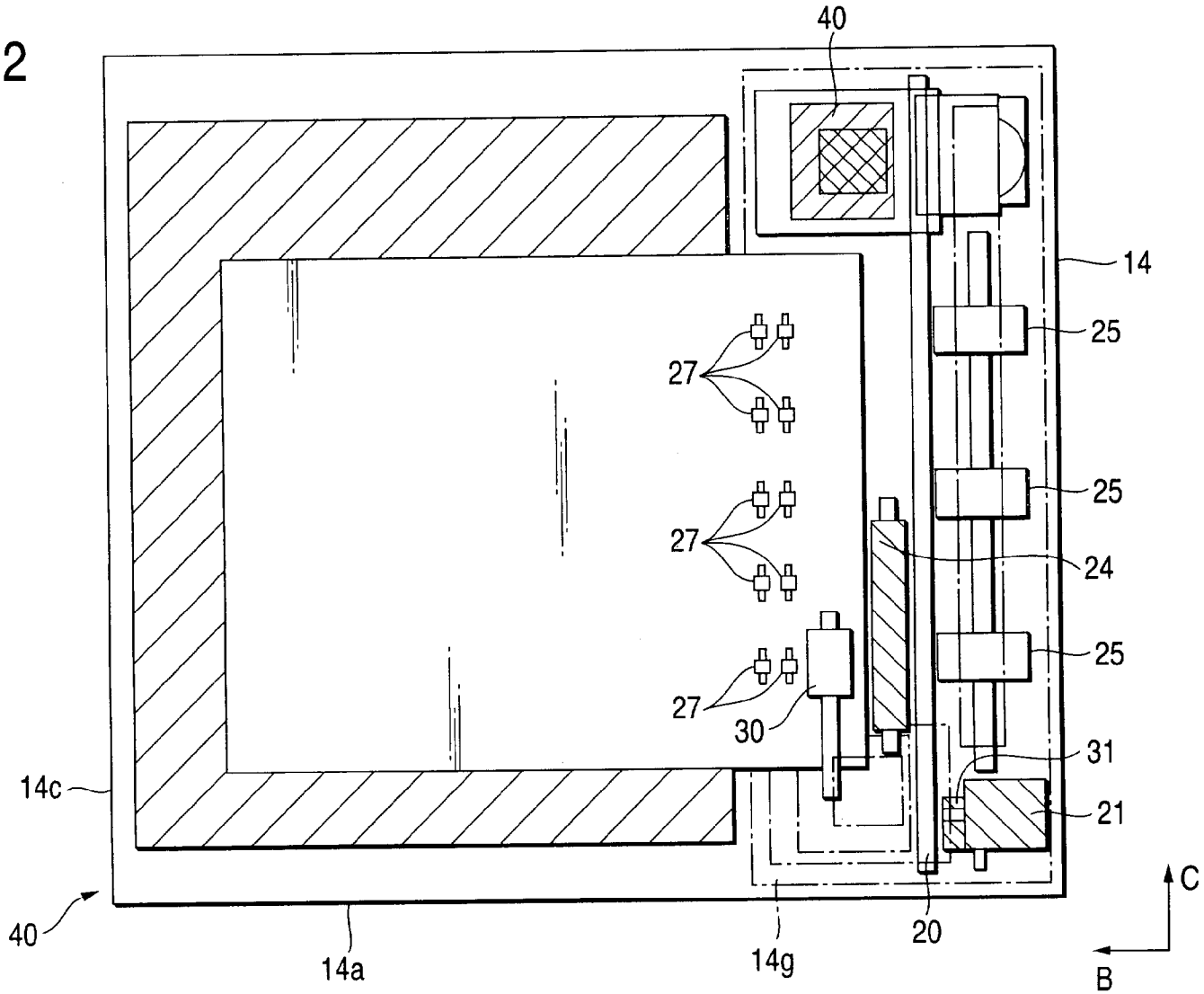
FIG. 2 is a plan view showing a major construction of the ink-jet recording device shown in FIG. 1.
Figure 3:
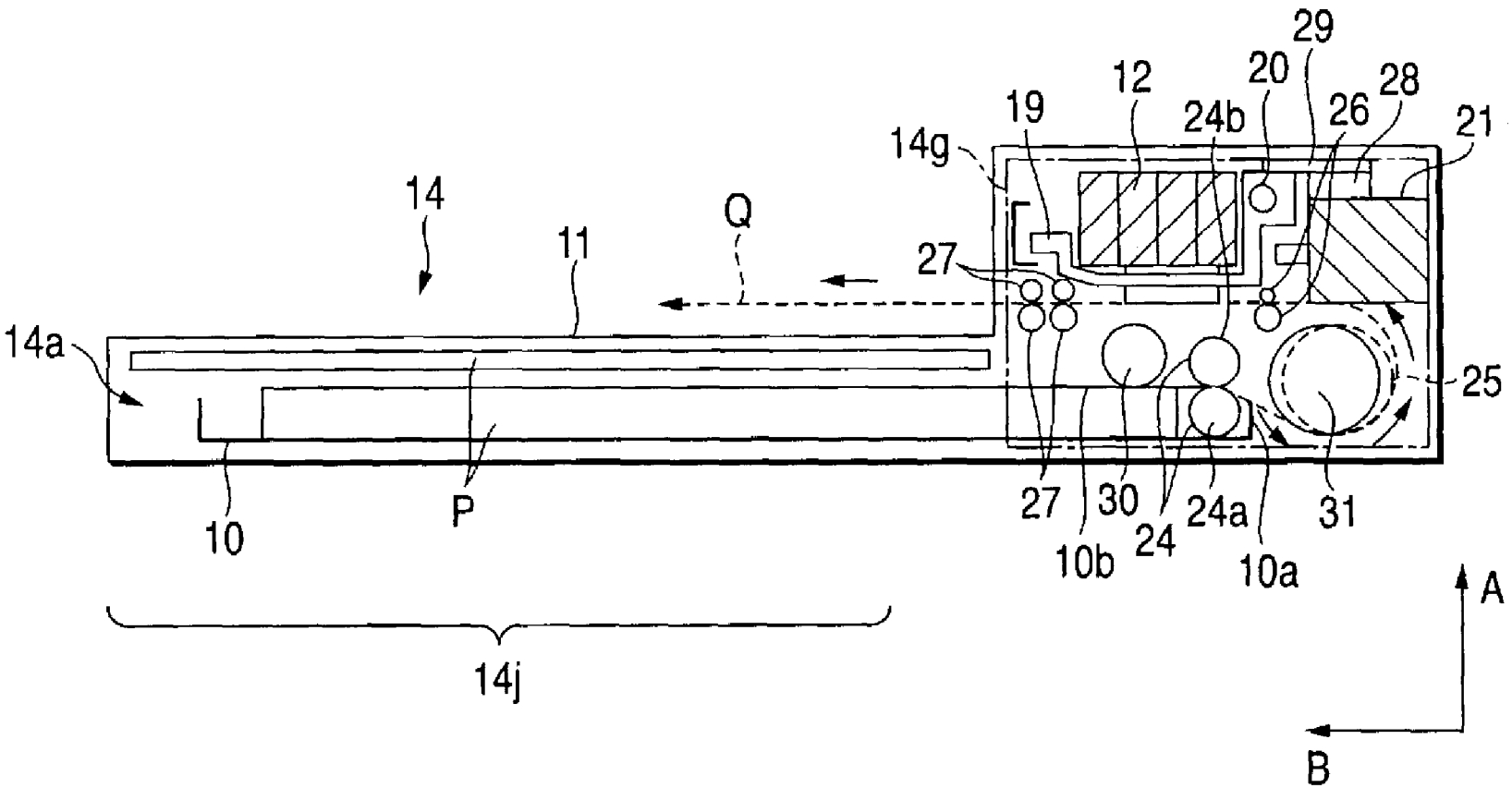
FIG. 3 is a front view showing a major construction of the ink-jet recording device shown in FIG. 1.
Figure 4:
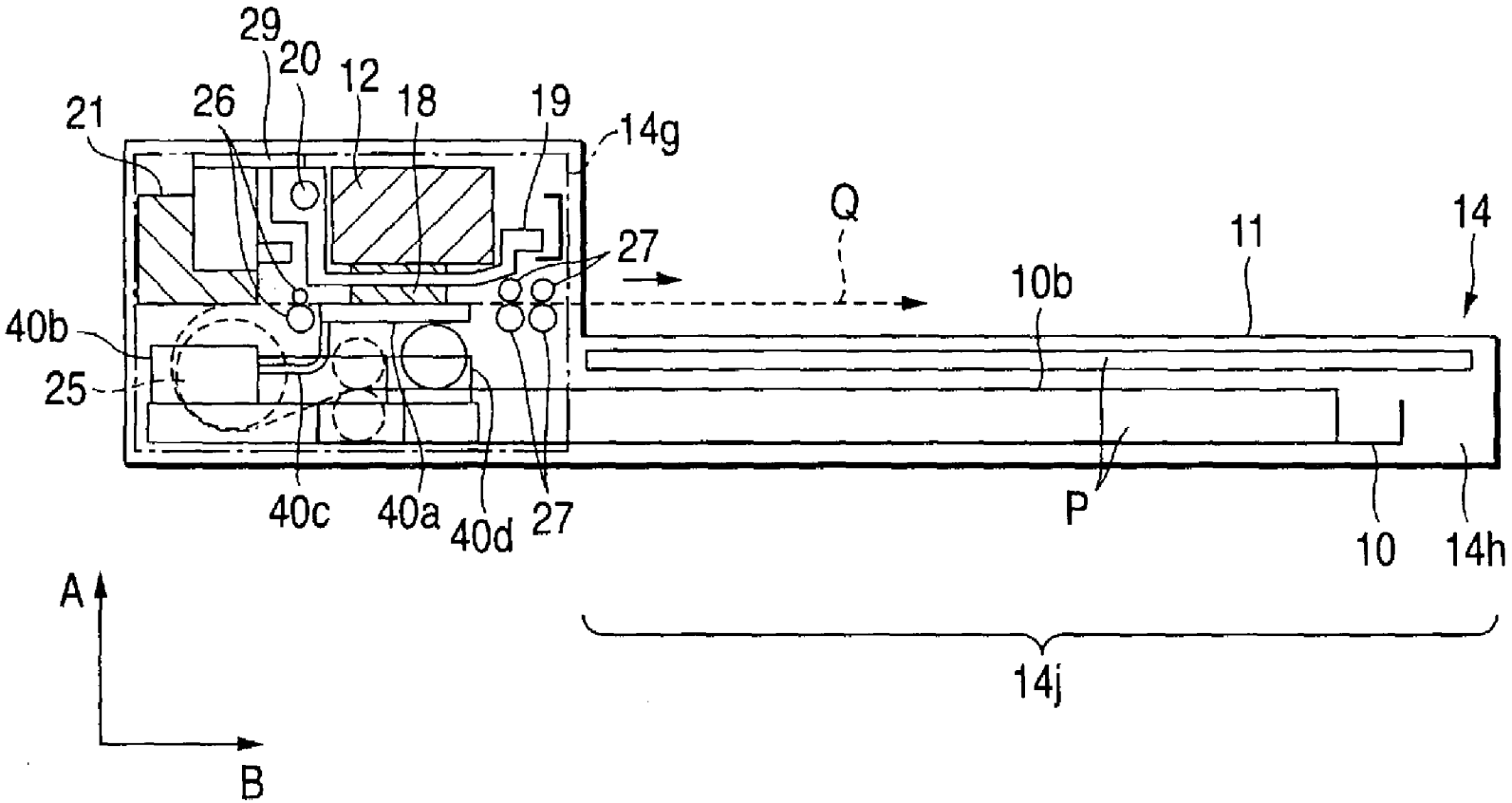
FIG. 4 is a rear view showing a major construction of the ink-jet recording device shown in FIG. 1.
Figure 5:
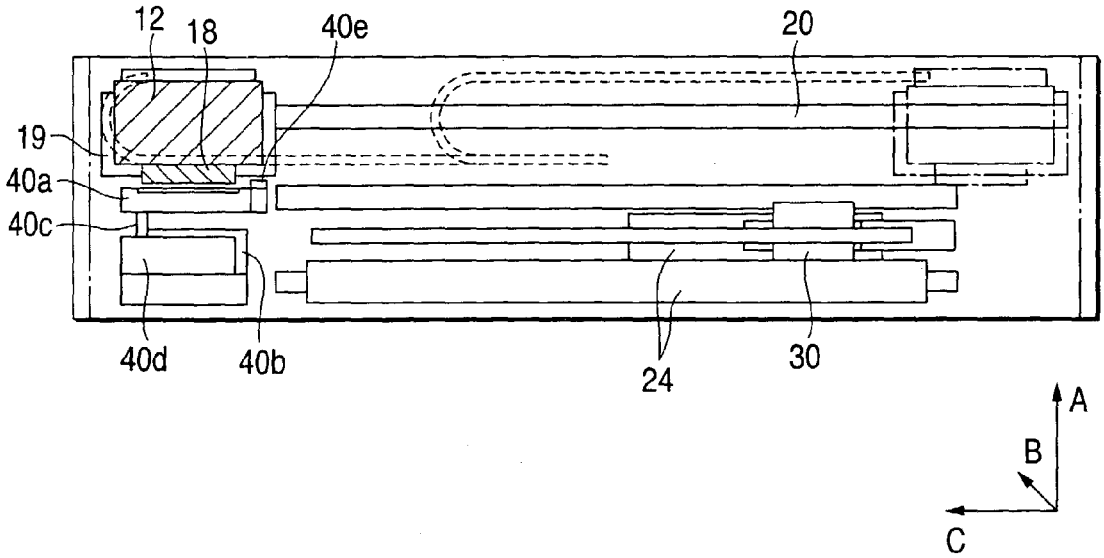
FIG. 5 is a left-side view showing a major construction of the ink-jet recording device shown in FIG. 1.
Figure 6:
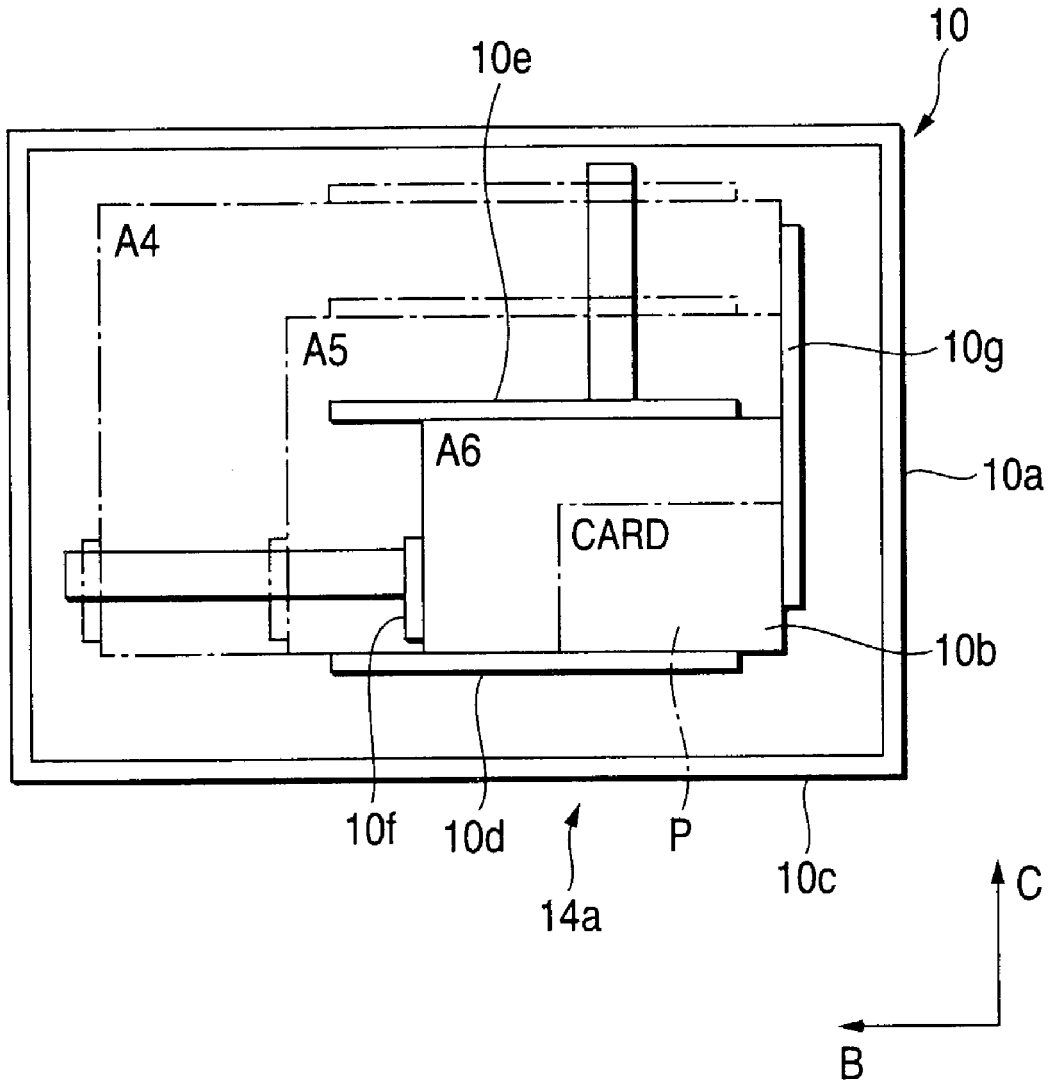
FIG. 6 is a top view showing discharging positions of recording media having different sizes located in a sheet discharge tray in the ink-jet recording device shown in FIG. 1 according to the first embodiment of the invention.

FIG. 1 is a front perspective view showing an outward appearance of an ink-jet recording device, which is a first embodiment of the invention. FIG. 2 is a plan view showing a major construction of the ink-jet recording device shown in FIG. 1. FIG. 3 is a front view showing a major construction of the ink-jet recording device shown in FIG. 1. FIG. 4 is a rear view showing a major construction of the ink-jet recording device shown in FIG. 1. FIG. 5 is a left-side view showing a major construction of the ink-jet recording device shown in FIG. 1. FIG. 6 is a top view showing sheet feeding positions of recording media having different sizes located in a sheet feeding tray in the ink-jet recording device shown in FIG. 1 as the first embodiment of the invention.

As shown in FIG. 1, an ink-jet recording device of the embodiment includes a sheet feeding cassette (medium feed portion) 10, a sheet discharge tray (medium discharge portion) 11, ink cartridges (ink supplying body) 12, and cartridge loading portions (ink supplying body loading portion) 13. The sheet feeding cassette 10 for feeding recording sheets (recording media) P is located in a lower part of a front surface 14*a* of a device body 14 with respect to a height direction A of the recording device. The sheet discharge tray 11 into which recorded recording sheets P are discharged is located in an upper part of the sheet feeding cassette. A plurality of ink cartridges 12 (of four colors, black, cyan, magenta and yellow in this instance) containing inks used for recording are located on the right side when viewing the front surface 14*a* of the device body, and are detachably attached to the carriage 19 directly. The cartridge loading portion 13 is defined by a space allowing the ink cartridges 12 to pass therethrough, and are provided in a recess extending to the interior of the device body 14. The cartridge loading portion 13 is a space ranging from an opening 13*a* formed in the front surface 14*a* of the device body 14 to cartridge loading parts (not shown) of the carriage 19, which are formed in the interior of the device body 14. Recesses to which the sheet feeding cassette 10 and the sheet discharge tray 11 are set may be formed in a state that those are surrounded by the device body 14 (no openings are formed in other surfaces of the device body 14 than the front surface 14*a*). Alternatively, one or more number of surfaces of the device body other than the front surface 14*a* are opened (for example, no top plate is formed) . With the structure that the recesses are formed while being surrounded by the device body 14, a chance that the user directly touches the transporting recording sheet is lessened. Accordingly, erroneous operation by the user rarely occurs to thereby provide a reliable ink-jet recording device.

Figure 17A:
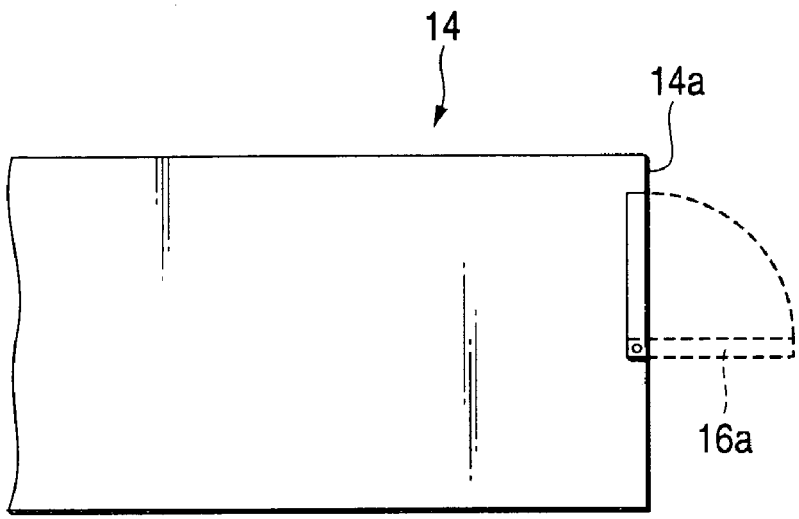
FIG. 17A is a side view showing a cover member in the first embodiment of the invention.
Figure 17B:
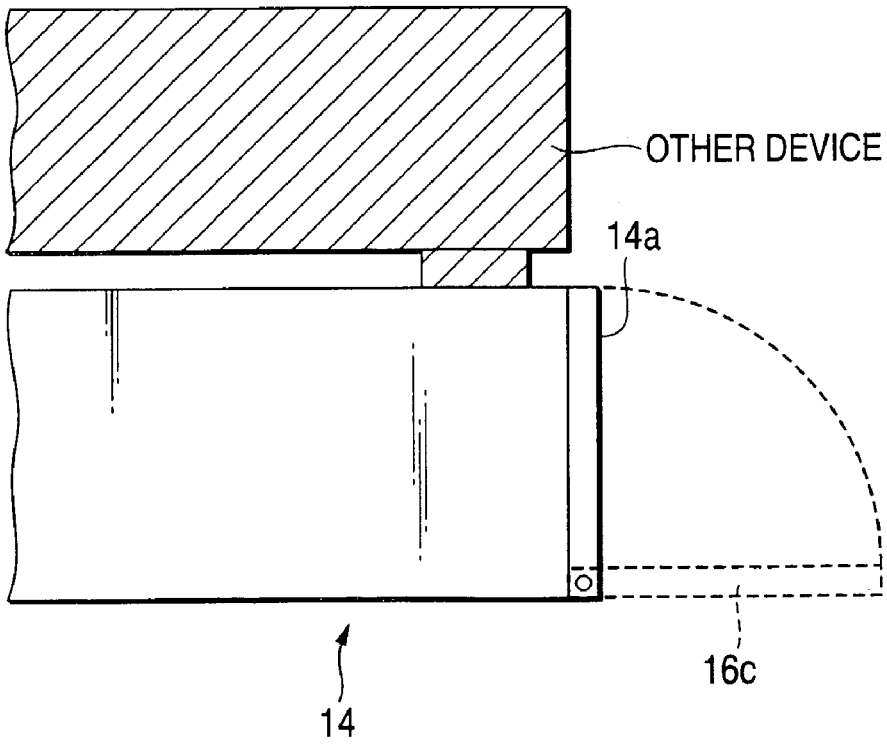
FIG. 17B is a side view showing a cover member in the first embodiment of the invention.

A cover member will be described with reference to FIGS. 1, 17A and 17B. Each of FIGS. 17A and 17B is aside view showing a cover member in the first embodiment of the invention. Cover members 16*a* and 16*b* (indicated by one-dot chain lines in FIG. 1) may be provided, respectively, for the openings of the cartridge loading portion 13 and the sheet discharge tray 11. When the cover members thus provided are opened downward, those may be utilized as an insertion guide for the ink cartridges 12 and a take-out guide for the recorded recording sheet P. In this regard, the operability of the ink-jet recording device is improved. Use of the cover members prevents dust from entering into the device body 14 to thereby minimize dust from attaching the recording sheet, and hence to minimize degradation of recording quantity. In the explanation above, the cover members 16*a*, 16*b* and 16*c* are all opened downward. If required, those cover members may be opened upward, to the right or left, or opened in a double-leafed hinged door manner. An opening angle of each cover member is about 90° in the illustrated instance; however, any other suitable angle than the angle of 90° may be used. When a guide for the ink cartridges 12 or the like is assigned to the cover member, 90° of the opening angle with respect to the front surface 14*a* will provide improved operability.

While the cover members 16*a* and 16*b* are separate members, a common cover member 16*c* maybe used which covers a major portion of the front surface 14*a* of the device body 14 (including at least the openings of the cartridge loading portion 13 and the sheet discharge tray 11), as shown in FIG. 17B. The same thing is true for the medium feed portion in a case where the sheet feeding cassette 10 is not used.

Since the cover members 16*a*, 16*b* and 16*c* are provided, an operating sound of the device body is reduced. In particular, use of the cover member 16*a* prevents ink mist and the like from scattering through the opening 13*a* when the carriage 19 is operated. Further, there is no chance that the user mistakenly touches the operating carriage 19, the deterioration of the recording quality is prevented.

In the embodiment, the cartridge loading portion 13 is formed with a single space corresponding to the plural ink cartridges 12. If necessary, it may be divided into spaces corresponding in number to the cartridges. All of the ink cartridges 12 (four ink cartridges in this embodiment) are arranged on the carriage 19 in the width direction B. Those ink cartridges (for example, of those four cartridges, two cartridges are stacked one on the other and the remaining two cartridges are also stacked or all of the four cartridges are stacked one on another) may be stacked in the height direction A.

The user directly accesses each ink cartridge 12 from the front surface 14*a* of the device body 14, removes the ink cartridge, and attaches a new cartridge thereto. In this way, the ink cartridges 12 can readily be replaced with the new one, regardless of the device installing location.

In the instant embodiment, the ink cartridges 12 contains of inks of black, cyan, magenta and yellow. To increase the image quality, the cartridges may contain so called photo inks of light cyan, light magenta, dark yellow, and the like. In this case, the number of cartridge loading parts on the carriage 19 is 6 or 7 depending on the number of kinds of inks used. The ink cartridge of black ink, for example, may be larger than the cartridges of other color inks, depending on an amount of ink used. Those different color ink cartridges may be combined into a single cartridge, i.e., a multicolor ink cartridge.

It is preferable that the installing surfaces of the sheet feeding cassette 10, the sheet discharge tray 11, the ink cartridges 12 and the cartridge loading portion 13 are substantially parallel to one another, since the device body 14 is more reduced in thickness. It is more preferable that the installing surfaces are substantially parallel to one another (substantially parallel to a surface defined by a width direction B and a depth direction C), since the device body 14 is most reduced in thickness. It is considered that "the installing surfaces which are substantially parallel to one another" involve those installing surfaces which are inclined at angles within ±10°. Similarly, it is considered that "the installing surfaces which are substantially horizontal to each other" involve those installing surfaces which are inclined at angles within ±10°.

An operation switch (operation system) 15 used for operation the ink-jet recording device is located on the front surface 14*a*. In a case where the operation switch 15 is thus located on the front surface 14*a* of the device body 14 or a surface similar to the front surface (for example, a surface stepped down from the front surface 14*a* in the direction C), the user more easily operates the operation switch than in a case where the operation switch 15 is located on the upper surface 14*b*, side surface 14*c* or the like. In this regard, the resultant ink-jet recording device is user friendly. Further, articles may be placed near the upper surface 14*b* and the side surface 14*c*. In other words, a space around the device body 14 is more efficiently utilized.

A normal line with respect to the front surface 14*a* or a surface similar to the front surface is vertical to a plane defined by the directions A and B. It is not essential that the normal line and the plane are vertically angled. If necessary, it may be smaller than the vertical angle (the surfaces are greatly inclined with respect to the user) . The surfaces maybe not only plane surfaces but also curved surfaces. When the front surface 14*a* or a surface similar to the front surface are thus inclined from its vertical direction, the user sees the front surface 14*a* with good visual recognition, further, the areas of the front surface 14*a* or a surface similar to the front surface are increased. If so done, the operation switch 15 installed there is increased in size and number to lead to improvement of the device operability by the user. The operation system may include a display portion 15*b* of LCD or LED or an insertion slot 15*a* for a semiconductor memory, in addition to the operation switch. The display portion may be a touch panel. It is preferable that connection terminals to PC or STB is also provided on the front surface 14*a* since the operability is improved. It is suggestible that the connection terminals which will be normally connected are provided on the rear surface. If so provided, connection cords are not seen from the user and hence; its aesthetics is not harmed A direction in which the sheet feeding cassette 10 is drawn out of (or inserted into) the device body 14, a direction in which a recorded recording medium is drawn out of the sheet discharge tray 11, and a direction in which the ink cartridges 12 are each drawn out of (inserted into) the cartridge loading portion 13 are each substantially the same.

Here, "substantially the same" direction means that main components of vectors representing the inserting or drawing-out motions of things have substantially the same directions. The same wording also means that even if the inserting or drawing-out motions of things have some vector components in the height direction A and the width direction B, the main components of the vectors consistently have the depth direction C.

With such a construction, the user may access the ink-jet recording device for its maintenance in only one direction. An ink-jet recording device having an excellent operability is realized. In particular at the time of ink cartridge replacement, there is no need of opening the covers applied to plural surfaces (for example, the front surface 14*a* and the upper surface 14*b*) of the ink-jet recording device. The maintainability of the device is considerably high, and at the time of replacement work, the necessity of rearranging the related portions (particularly the upper surface 14*b*) is lessened.

A location in which recording media are placed may be a tray construction or a cassette to be attached to and detached from the device body. In the embodiment, a tray construction is used for storing discharged recording media, and a cassette construction is employed for storing recording media therein and supplying the same therefrom.

And, in particular when the cassette is used, the inserting direction and the drawing-out direction, respectively, represent a direction in which the cassette storing the recording media therein is inserted into the device body and a direction in which such a cassette is drawn out of the device body.

When the insertion slot 15*a* for a semiconductor memory or a PC card is provided, it is preferable that directions in which the semiconductor memory or the PC card is inserted into or drawn out of the slot are the same as the above-mentioned directions.

It is preferable that the upper surface 14*b* of the device body 14 takes the form of a plane. If it is a plane, documents, files and like may be put on the upper surface 14*b*. When considering that the ink-jet recording device is stacked on electrical appliances, the number of which is relatively large in the living room, such as audio deck and video deck, parts of the ink-jet recording device, which are confronted with the legs of those products (generally the four corners of the device body 14) are positioned preferably in equal levels to thereby secure its stable stacking In this case, if the four corners are in equal levels, no problem arises if the levels of the remaining parts are not equal. For example, projections may be provided only at the four corners. To endure a number of stacked devices, it is preferable that the parts of the recording device on which another device is stacked are more reinforced than other parts. In this case, it is preferable to design the recording device so that the user easily finds the reinforce parts. If so done, it is prevented that the user mistakenly handles the recording device to damage the device body 14. Some ways to let the user know the reinforced parts are description on the reinforced parts given on the device body 14 or in its instruction manual.

As shown in FIGS. 2 to 5, the ink cartridges 12 loaded through the cartridge loading portion 13 and the recording head 18 supplied with ink from the ink cartridges 12 are supported on the shaft 20 within the device body 14, and are reciprocatively moved in the main scanning directions (in the depth direction C of the device body) when those are driven by the carriage motor 21 through drive force transmitting unit (not shown) such as a timing pulley, timing belt. The direction of the main scanning is perpendicular to that by the technique in the related art, which reciprocatively moves the cartridges and the recording head to scan in the width direction B of the device, in a horizontal plane. Specifically, those members are reciprocatively moved from the inner part to this side and from this side to the inner part when viewed from the front surface 14*a* of the device body 14.

And, when the carriage 19 is on the front surface 14*a* side of the device body 14, the ink cartridges 12, as described above, is directly replaced with a new one through the cartridge loading portion 13 from the front surface 14*a* side, without operating a large cover-like member higher than the height of the device body by opening plural surfaces of the device body. With such a construction, replacement of the cartridge from the front surface of the ink-jet recording device, which is difficult in the technique of related art, is enabled. Influence of the cartridge replacing work on the peripheral space is minimized. The front surface operation, in its real sense, including the inserting/drawing-out of the recording medium, operations to the operation system, and the like are possible. Further, stacking of it on another device, and placing of it into a narrow space of the cabinet or the like are easily done. Accordingly, an ink-jet recording device which is able to efficiently utilize its peripheral space is realized.

The main scanning direction of the carriage 19 (may be defined by a line direction in the case of the line recording device in the serial recording device) is substantially the same as the inserting/drawing-out direction of the sheet feeding cassette 10, the inserting/drawing-out direction of the ink cartridges 12, and the drawing-out direction of the recording sheet P from the sheet discharge tray 11. A main component of a vector representing the scanning direction is perpendicular to the transporting direction of the recording sheet P. With such a construction, an operability of the ink-jet recording device in which the front surface operation is possible is improved.

The ink cartridges 12 (opening 13*a* of the cartridge loading portion 13) is disposed to be flush with the surface 10*c* of the sheet feeding cassette 10 closer to the surface 14*a*, and the opening 11*a* of the sheet discharge tray 11. With this feature, maintenance operations, such as replenishment, and drawing-out of recording media by the user, and inserting/drawing-out of the ink cartridge, are easily performed.

Here, the "flush with" involves an offset of the cartridges from the surface 10*c* and the opening 11*a* within which the user may smoothly perform maintenance operations. If the offset is within a range allowing the user to perform the maintenance operations with his finger in the depth direction C (about ±5 cm although it is different among individuals), no problem arises even when other devices (e.g., audio deck video deck, and the like) is placed on the device body 14.

Most of parts which requires operations of the operation system 15 and the like by the user are disposed at positions near the surface of the front surface 14*a* side of the device body 14*e*. Therefore, the invention succeeds in realizing an ink-jet recording device which is good in using handiness and high in space utilizing efficiency.

Thus, in the ink-jet recording device of the embodiment, the ink cartridge 12 is detachably loaded into the cartridge loading portion 13 extending from the front surface to the device body 14 to the interior of the device. Accordingly, the user can attach the ink cartridge 12 to and detach from the device body, from outside.

For the construction of the ink-jet recording device so arranged as to be operated from such a specific one surface (front surface 14*a*) , particularly as shown in FIGS. 3 and 4, a sheet discharging system 14*j* including the sheet feeding cassette 10 and the discharge tray 11 and others are provided in a region ranging from the center of the device body 14 to a side part thereof when viewed from a specific surface (the front surface 14*a* in this instance) at which the maintenance or operations are performed, and a mechanical system for transporting the recording medium, the recording head 18 and the carriage 19, in particular in the case of the serial recording, a recording block 14*g*, such as a maintenance unit including at least a carriage drive system for operating it, the capping unit, and the wiping unit, are preferably disposed in a region occupying a side part different from the side part referred to above. When so constructed, the device body 14 is considerably reduced in thickness, and the recording block 14*g* part may also be applied to another type of ink-jet recording device. For example, of the ink-jet recording device under discussion, a U-turn path recording device in which the transporting recording medium is U-turned and transported and a straight path recording device in which the recording medium is linearly passed, and the sheet feeding tray and a sheet discharge tray are oppositely disposed on both sides of the recording block 14*g* may both employ the recording blocks of which the constructions are substantially the same. For this reason, the recording block 14*g* may be made in a module, to thereby increase a productivity of the ink-jet recording device. This is made easier particularly when a pickup roller 30, a first transporting roller 24 and others, which are to be described later, are provided within the sheet feeding cassette 10.

It is not essential that the sheet discharging system 14*j* and the recording block 14*g* are partitioned by an exact plane, but both of them may coexist in a region in the device body 14. In the embodiment, the recording block 14*g* is located in the right side part; however, it may be located in the left side part, if necessary.

A cable 28 for transmitting a head drive signal from a drive signal generator to the recording head 18 is disposed so as not to hinder the transporting of the recording sheet P and the movement of the carriage 19, and connected to an electrical connection part (not shown) via a head relaying substrate 29. A flexible member, such as a flexible printed circuit, may be used for the cable 28.

A maintenance system of the recording head 18 will now be described.

The ink-jet recording device of the embodiment is provided with a maintenance unit 40. The maintenance unit performs a wiping operation for wiping out a nozzle face of the recording head 18, and a capping operation for suppressing occurrence of nozzle clogging of the recording head 18. If necessary, the following functions may be given to the maintenance unit: nozzle sucking of the recording head 18; sucking of ink collected in the cap part 40*a*; receiving of ink from the recording head 18 after a preparatory ink ejection; and others. The maintenance unit 40 to be described here has all of the functions mentioned above. In this case, the maintenance unit 40 includes a cap part 40*a*, provided in opposition to the recording head 18, which comes in contact (preferably close contact) with the surface of the recording head 18 upon occasion to restrict the drying of ink on the nozzle face, and in some cases, is linked with a pump part 40*b* to suck ink, the pump part 40*b* for sucking ink from the recording head 18, a fluid joining part 40*c* for fluid-joining the cap part 40*a* and the pump part 40*b*, a motor part 40*d* which generates a drive force for making and breaking a contact of the cap part 40*a* and a wiping member 40*e*, and transmits it to the cap part 40*a* via a gear train (not shown), and the wiping member 40*e* for wiping out the nozzle face (surface) of the recording head 18. The motor part 40*d* may be used as a power source for the pump part 40*b*. An ink absorbing body, if necessary, may be provided within the cap part 40*a*.

Next, the transporting system of the recording medium will be described.

The transporting system includes the pickup roller 30, the first transporting roller 24, a U-turn roller 25, a second transporting roller 26, and a discharging unit 27, which are successively disposed in the transporting direction of the recording sheet P. The pickup roller 30 picks up recording sheets P sheet by sheet from the sheet feeding cassette 10. The first transporting roller 24 transports the recording sheet P picked up by the pickup roller 30 somewhat downward. The U-turn roller 25 U-turns the recording sheet P coming from the first transporting roller 24 and transports the same. The second transporting roller 26 transports the recording sheet P coming from the U-turn roller 25 after its direction is changed by about 180°. The discharging unit 27 discharges the recorded recording sheet P to the sheet discharge tray 11. A transporting path through which the recording sheet P travels is indicated by a dotted line Q. Power is transmitted from a line feed motor 31 to movable parts of mechanical components forming the transporting system, via a gear train (not shown).

The pickup roller 30 and the first transporting roller 24 are disposed within the sheet feeding cassette 10. With the inserting/drawing-out of the sheet feeding cassette 10, at least a part of it is transportable to outside. More preferably, the lower transporting roller 24*a* is disposed in the sheet feeding cassette 10, and the pickup roller 30 and the upper transporting roller 24*b* are both disposed in the device body side. If so arranged, the user can easily remove a trouble, such as jamming, when it occurs at a location near the sheet feeding cassette 10, and in this regards, an ink-jet recording device having a good operability is provided. Such a mechanical arrangement is effective particularly for a case where the recording sheet P (in this case, the sheet feeding cassette 10) is input to and output from the device body 14 at an inclination of an angle (about 90° in this instance ) with respect to the transporting direction of the recording sheet P (that is, for a case where the transporting direction and the inserting/drawing-out direction of the recording sheet P is different).

The pickup roller 30 is provided such that it comes in contact with the upper surface (pickup surface 10*b*) of the top recording sheet of the recording sheets P stacked in the sheet feeding cassette 10 at least when the recording sheet is picked up. A semilunar roller or a circular roller may be used for the pickup roller 30.

The first transporting roller 24 includes plural transporting rollers (two rollers in this instance), vertically separated. To prevent recording sheets from doubly being transported, it is preferable that the lower transporting roller 24*a* of the first transporting roller 24 is standstill or reversely rotated till the trailing end of the recording sheet passes the pickup roller 30. The lower transporting roller 24*a* may be a separation pad if it has a separating operation.

Thus, at least some components forming the transporting system, such as the pickup roller 30 and the first transporting roller 24, are disposed in the sheet feeding cassette 10. Accordingly, the recording sheet is stably fed and transported.

In the embodiment, the U-turn roller 25 (for changing the transporting direction of the recording medium so that a main component of a vector representing the transporting direction of the recording medium is inverted) includes a roller member of a large diameter and a guide member (not shown) disposed around it. The lower surface (bottom as viewed in the height direction A) is located at a position lower than the transporting path (indicated by a dotted line Q in FIGS. 3 and 4) in the first transporting roller 24 (in other words, the transporting path of the recording medium in the first transporting roller 24 is located at a position higher than the lower surface of the U-turn roller 25 as viewed in the height direction A).

More preferably, the transporting path at the bottom of the U-turn unit 25 is located at a position lower than the transporting path at the first transporting roller 24 (more exactly, higher than the bottom of the components, such as the roller and pad, which form the first transporting roller 24 as viewed in the height direction A).

Where the positional relationship between the U-turn roller 25 and the first transporting roller 24 or pickup roller 30 is thus set up, a dead space which is generated around the sheet feeding cassette 10 (or merely a region where the recording medium is placed) caused by the provision of the sheet feeding cassette 10 is effectively used, and the upper surface of the U-turn roller 25 can be located at a lower position . As a result, the height of the ink-jet recording device is more reduced, and the size and thickness reduction which becomes problematic when it is placed into the cabinet is realized.

In connection with the pickup roller 30, the bottom of the U-turn roller 25 is lower than the pickup roller 30. More specifically, the bottom of the U-turn roller 25 is lower than the pickup surface 10*b* at which the pickup roller 30 picks up the recording sheet P as viewed in the height direction A. In other words, the bottom of the roller forming the pickup roller 30 is higher than the bottom of the U-turn roller 25 as viewed in the height direction A. Where such a construction is employed, the advantages mentioned above are more effectively obtained.

The second transporting roller 26 includes a main roller for determining a transportation accuracy of the recording sheet P, and an encoder for measuring a rotation accuracy, both being on the same shaft. As the encoder is larger, the number of slits formed therein is more increased, so that securing an accuracy is easy. To make it easy for the ink cartridges 12 and the recording sheet P (or sheet feeding cassette 10) to be inserted into and drawn out of the device body, the encoder is preferably located at an inner part when viewed from the front surface 14*a* in the depth direction C. If so located, its configuration is less restricted with its interference with other constituent elements less, so that the encoder is further increased in size. It is preferable that such a member as a plate for preventing attaching of ink mist, for example is provided between the encoder and the maintenance unit 40. With provision of such, deterioration of detection accuracy is lessened.

The discharging unit 27 includes transporting rollers and spur rollers. A plurality of roller trains (two roller trains in this instance) are arranged in the transporting direction of the recording sheet P. Each roller train consists of a combination of a plurality of transport rollers (five in this instance) and spur rollers, oriented perpendicular to the transporting direction of the recording sheet P.

The transporting rollers and the spur rollers are used for the elements constituting the transporting system. The transporting roller is made of a material, such as rubber, resin, ceramic and metal, and in this instance, it is made mainly of rubber. A roller made of ceramic or thermally sprayed metallic material is preferably used for the main roller of the second transporting roller 26 in order to secure an exact transportation. A roller made of resin, metal or the like may be used for the spur roller. The same thing is correspondingly applied to each transporting roller forming the transporting systems in embodiments 2 and 3.

The recording sheets P are picked up sheet by sheet from the sheet feeding cassette 10, which is loaded in the depth direction of the device body (depth direction C) from the front surface 14*a* of the device body 14, and the transportation of the recording sheet P starts. The transporting direction of the recording sheet P is the width direction (width direction B) of the device body 14, and more exactly a direction toward a side (to the right in this instance) when viewing the front surface 14*a* of the device body 14.

The inserting/drawing-out direction of the recording sheet P (the inserting/drawing-out direction of the sheet feeding cassette 10) is different from the transporting direction of the recording sheet P (in other words, those directions are inclined at an angle(about 90° in this instance)). Accordingly, it is little influenced by a reaction generated when the sheet is picked up, and hence, the recording sheet P is hardly skewed.

The recording sheet P of which the transportation is started by the pickup roller 30, is transported further to a side (right in this instance) by the first transporting roller 24. The first transporting roller 24 is disposed so that the recording sheet P has a vector directed downward with respect to a horizontal plane (B-C plane) . Accordingly, the recording sheet P is transported somewhat downward (to the lower left, here). The transporting direction of the recording sheet P may be directed downward by use of a sheet guide or the like.

The recording sheet P having passed the first transporting roller 24, as shown in FIG. 2, is guided to the U-turn roller 25 while being supported at the end part 10*a* of the sheet feeding cassette 10. Accordingly, in the sheet transporting path ranging from the pickup roller 30 to the U-turn roller 25, the recording sheet P is transported having a vector directed downward in the height direction A as a whole. As a result, the dead space within the device is more reduced to thereby realize the size reduction and thickness reduction of the device.

By the U-turn roller 25, the recording sheet P is transported along the U-turn roller and its advancing direction is changed by about 180°. Specifically, the recording sheet moving to a side (right, here) when viewed form the front surface 14*a* of the device body 14 moves to an opposite side (left, here) when viewed from the front surface 14*a* of the device body 14, after it passed the U-turn roller 25.

The recording sheet P having passed the U-turn roller 25 is transported further to a side (left, here) by the second transporting roller 26, and guided to a surface being confronted with the recording head 18. The recording sheet P having a given image recorded thereon by ink ejected from the recording head 18 is then discharged onto the sheet discharge tray 11 by the sheet discharging unit 27. The user directly accesses the sheet discharge tray 11 from the front of the recording device and takes out the already recorded recording sheet P. Incidentally, a supporting unit for the recording sheet P such as a platen is provided (not shown) on the side opposite to the recording head 18 with respect to the recording sheet P between the second transporting roller 26 and the discharging unit 27.

Next, positions of the end faces of recording sheets P with respect to the front surface 14*a* will be described.

As shown in FIG. 6 (the pickup roller 30 and the first transporting roller 24 are omitted for ease of understanding), the recording sheet P is located in a region within the sheet feeding cassette 10, which is surrounded by a reference position (a plate member formed parallel to the transporting direction) 10*d* closer to a surface 10*c* of the sheet feeding cassette 10 (in other words, this side as viewed in the depth direction (direction C) of the sheet feeding cassette 11), a fixed wall member 10*g*, and movable partitioning plates 10*e* and 10*f*. Accordingly, even when the recording sheet P of any size is set in the sheet feeding cassette 10, the end face of the recording sheet closer to the front surface 14*a* of the device body 14 is always located at a position substantially equally distanced from the front surface 14*a* of the device body 14, A discharging position of the recorded recording sheet P in the sheet discharge tray 11 substantially corresponds to the position of the recording sheet P located in the sheet feeding cassette 10. Accordingly, the recording sheet P of any size is discharged to a position on the sheet discharge tray 11, which is closer to the front surface 14*a*.

Thus, the end of the recording sheet P, even if it has any size, is substantially equally distanced from the front surface 14*a* of the device body 14. Accordingly, the invention succeeds in providing an ink-jet recording device which has good use convenience and enables the user to easily take out discharged recording medium.

This advantage is remarkable in the ink-jet recording device of the embodiment in which the scanning direction, the inserting/drawing-out of the sheet feeding cassette 10, the taking-out direction of the recorded recording sheet P from the sheet discharge tray 11 are perpendicular to the transporting direction of the recording sheet P. That is, an operability of the ink-jet recording device is improved at the from it surface 14*a* through which the recording sheet P and the ink cartridges 12 are inserted into and taken out of the device body.

In the instant embodiment, the reference position 10*d* is located within the sheet feeding cassette. In a case where the medium feed portion is not the sheet feeding cassette 10 but a tray insertably provided in the device body 14, and the recording medium is directly inserted into and taken out of the tray, and an opening part merely formed in the device body, the reference position may be provided within the opening of the device body.

Embodiment 2

Figure 7:
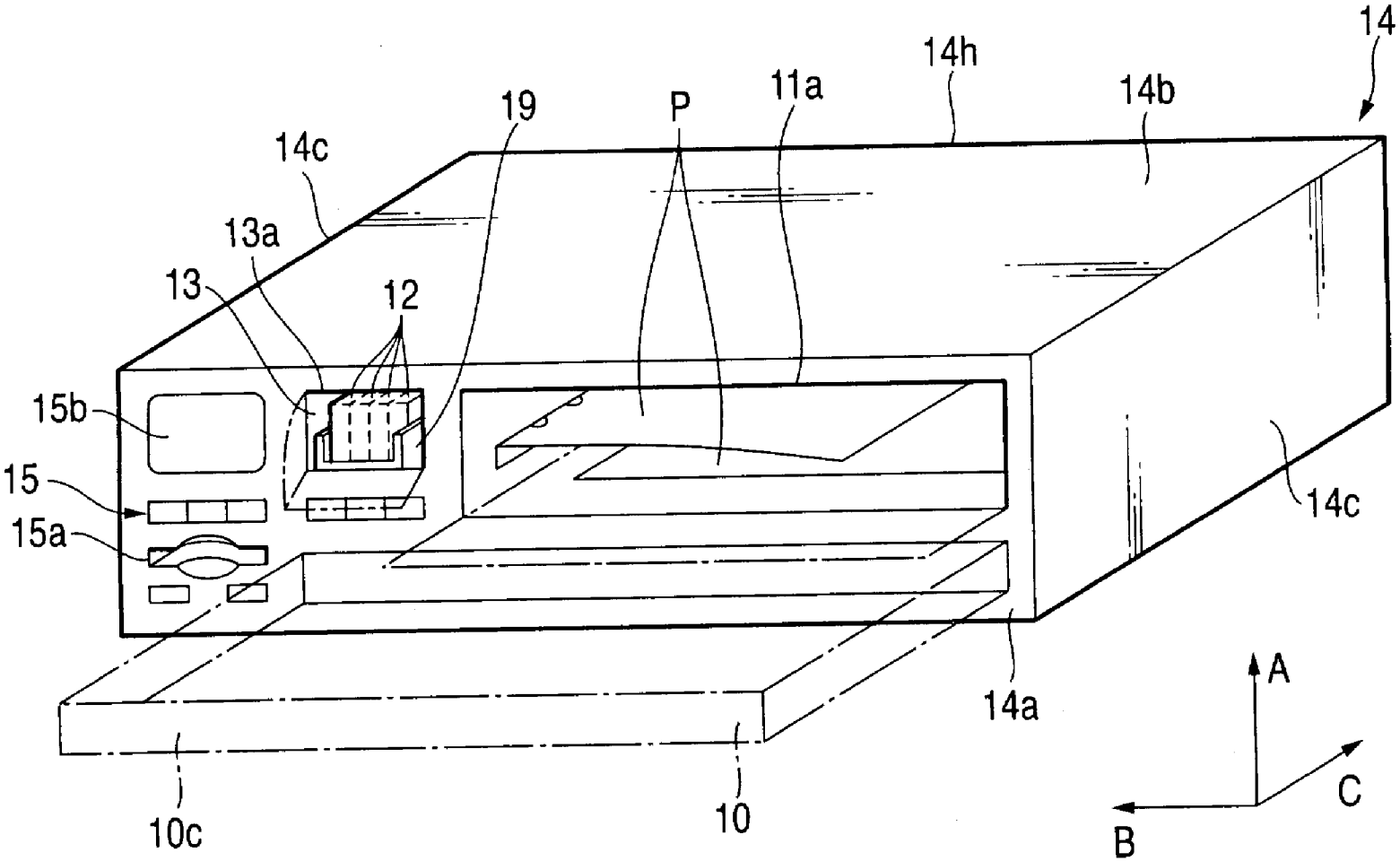
FIG. 7 is a front view perspectively showing an outward appearance of an ink-jet recording device, according to a second embodiment of the invention.
Figure 8:
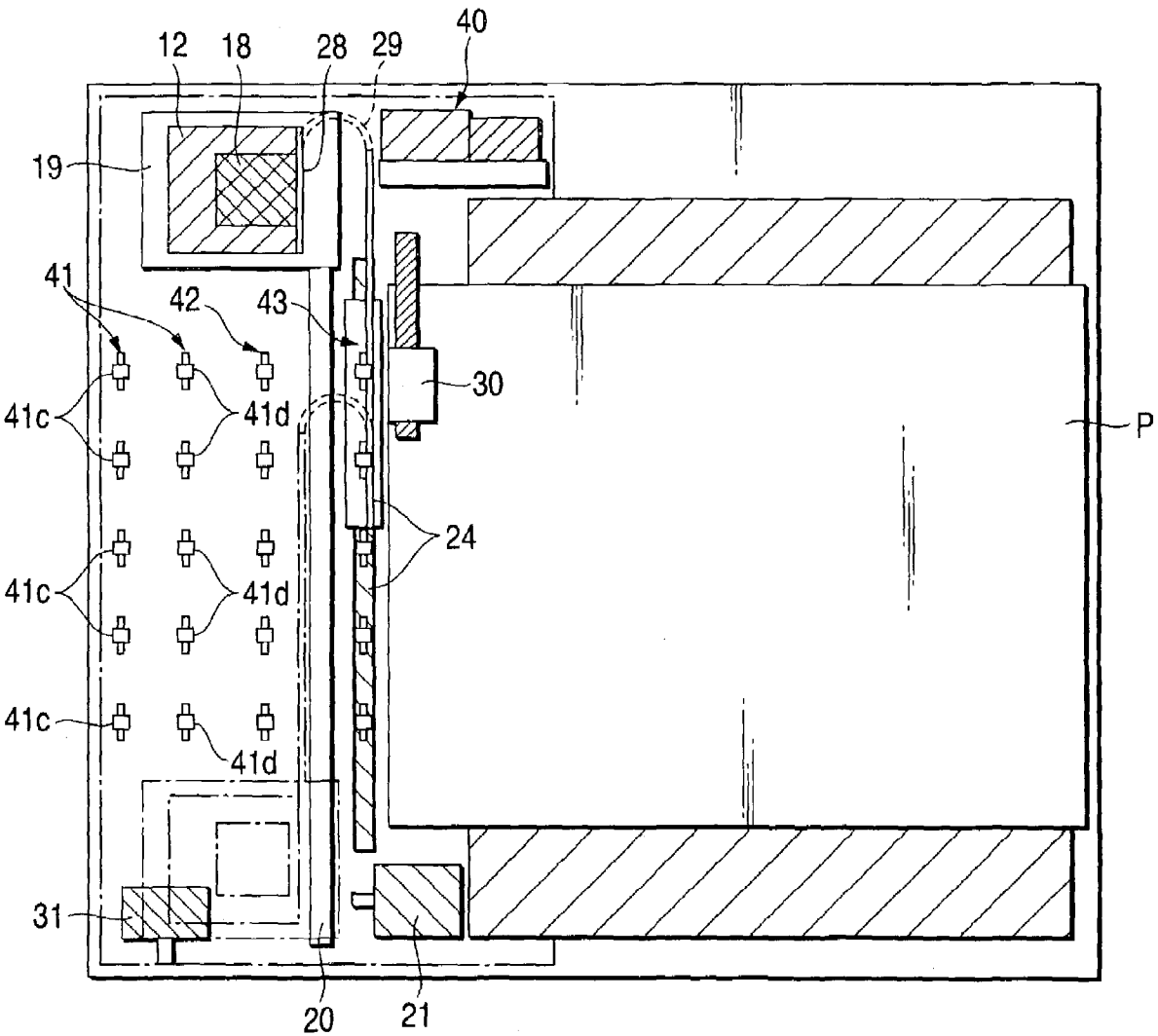
FIG. 8 is a plan view showing a major construction of the ink-jet recording device shown in FIG. 7.
Figure 9:
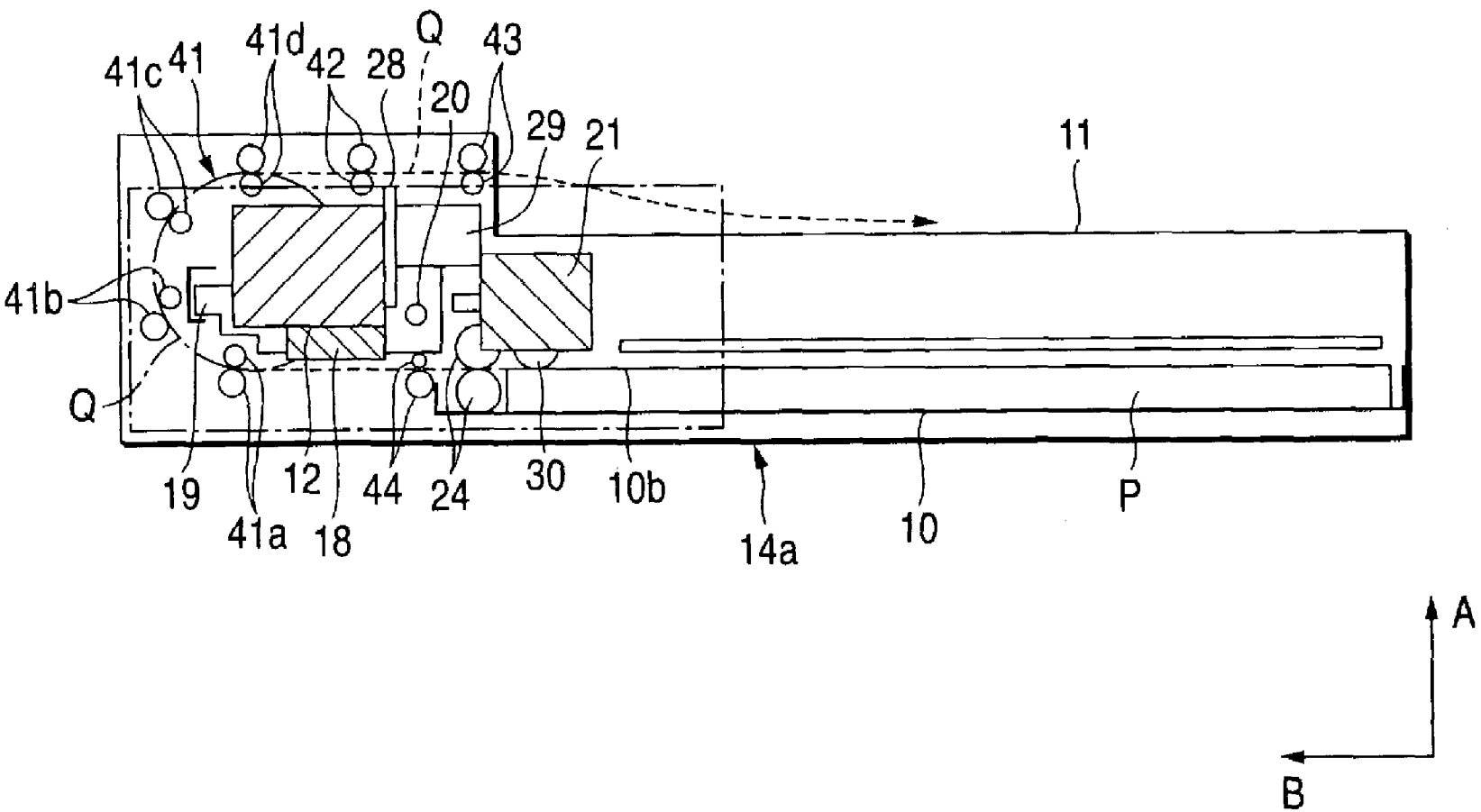
FIG. 9 is a front view showing a major construction of the ink-jet recording device shown in FIG. 7.
Figure 10:
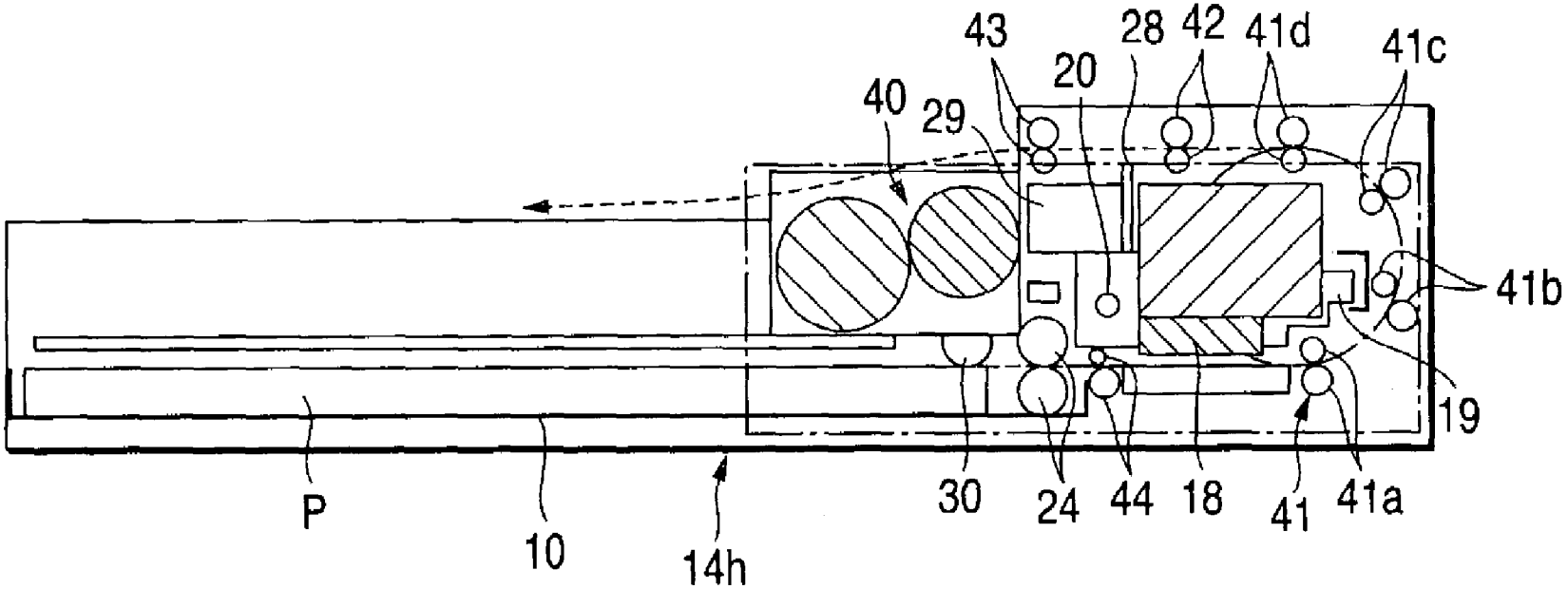
FIG. 10 is a rear view showing a major construction of the ink-jet recording device shown in FIG. 7.
Figure 11:
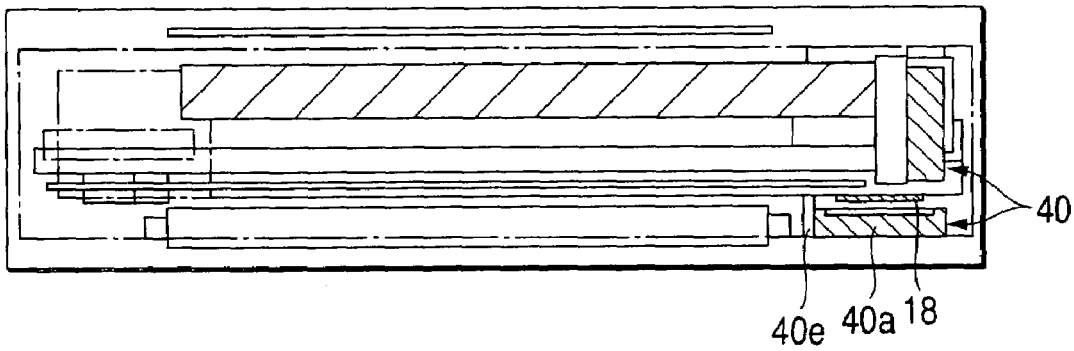
FIG. 11 is a left-side view showing a major construction of the ink-jet recording device shown in FIG. 7.

FIG. 7 is a front view perspectively showing an outward appearance of an ink-jet recording device, which is a second embodiment of the invention, the outward appearance being substantially symmetrical in configuration to that of FIG. 1 showing the first embodiment. FIG. 8 is a plan view showing a major construction of the ink-jet recording device shown in FIG. 7. FIG. 9 is a front view showing a major construction of the ink-jet recording device shown in FIG. 7. FIG. 10 is a rear view showing a major construction of the ink-jet recording device shown in FIG. 7. FIG. 11 is a left-side view showing a major construction of the ink-jet recording device shown in FIG. 7. In the instant embodiment, within a scope as viewed from the front surface 14*a*, the sheet feeding cassette 10, the sheet discharge tray 11, the operation switch 15, the cartridge loading portion 13 and the carriage 19 are all located at positions, which are symmetrical to those in the embodiment 1. The transporting direction of the recording sheet is opposite to that in the first embodiment. The internal construction and the operations of the device body 14, which are different from those in the embodiment will be described hereunder. For constructions of the instant embodiment which are substantially the same as of the first embodiment, no description will be given, while designating related portions by like reference numerals.

A transporting system in the instant embodiment is different from the first embodiment in a second transporting roller 44, a U-turn roller 41, a third transporting roller 42 and discharge unit 43. The second transporting 44 transports a recording sheet P coming from the first transporting roller 24. The U-turn roller 41 (for changing the transporting direction of the recording medium so that a main component of a vector representing the transporting direction of the recording medium is inverted) U-turns the recording sheet P coming from the first transporting roller 24. The third transporting roller 42 transports the recording sheet P coming from the U-turn roller 41 after its direction is changed by about 180°. The discharge unit 43 discharges the recorded recording sheet P to the sheet discharge tray 11.

The U-turn roller 41 includes roller trains 41*a* to 41*d* each having a combination of a plurality of transport rollers and spur rollers, the diameter of each roller being smaller than that of each of the rollers forming the U-turn roller 25 in the first embodiment. The transporting roller is located outside a transporting path Q and the spur roller is located inside the transporting path Q. By thus locating the spur roller within the transporting path Q, the recording sheet P is reliably transported while preventing soiling of the recording surface, with a minimum arrangement (its contact with the recording surface is minimized) . And an ink-jet recording device producing an image at high recording quality is realized.

As shown in FIGS. 9 and 10, the roller trains 41*a* to 41*d* are disposed to cover (or surround) the recording head 18 or a region where the recording head 18 records on a recording medium, or a part of the scanning region of the carriage 19 (or a part of the head unit in the case of the line head) . The lower-most transporting roller of the roller train 41*a* of the U-turn roller 41 as viewed in the height direction (direction A) of the device body 14 is lower than the recording head 18 or a region where the recording head 18 records on a recording medium, or the scanning region of the carriage 19 (or the shortest member (recording head 18, here) on the carriage 19 as viewed in the height direction). The uppermost transporting roller of the roller train 41*a* of the U-turn roller 41 is higher than the recording head 18 or a region where the recording head 18 records on a recording medium, or the scanning region of the carriage 19 (the highest member (ink cartridges 12 or head relaying substrate 29, here) on the carriage 19 as viewed in the height direction) . A radius of curvature of the recording sheet P transported by the U-turn roller 41 may be set at a maximum value of it. Accordingly, a reliable ink-jet recording device in which paper jamming rarely occurs even at the time of thick-paper transporting, is realized.

The third transporting roller 42 has a function to transport the recording sheet P coming from the U-turn roller 41 toward the discharge unit 43, and includes transporting rollers and spur rollers. The third transporting roller 42 is constructed with a roller train which consists of a combination of a plurality of transport rollers and spur rollers (five rollers in this embodiment, respectively), oriented perpendicular to the transporting direction of the recording sheet P. The transporting roller is locate data position higher than the recording head 18 or a region where the recording head 18 records on a recording medium, or the member (ink cartridges 12 or head relaying substrate 29, here) located at the highest position on the carriage 19 (and the member mounted therein) as viewed in the direction A.

The discharging unit 43 includes transporting rollers (may be metal rollers coated with resin) and spur rollers. A roller train consists of a combination of a plurality of transport rollers and spur rollers (five rollers in this embodiment, respectively), oriented perpendicular to the transporting direction of the recording sheet P. The transporting roller is located at a position higher than the recording head 18 or a region where the recording head 18 records on a recording medium, or the highest member (ink cartridges 12 or head relaying substrate 29, here) on the carriage 19 (and the member mounted on it) as viewed in the height direction), as viewed in the height direction A of the device body 14.

Thus, by locating the discharging unit 43 at a position higher than the member on the carriage 19 as viewed in the direction A, a sheet discharging position is set at a higher position as viewed in the direction A, therefore, the number of recorded recording media to be stacked can be increased. In some kinds of paper sheets, a thickness of paper sheets after recorded is 1.2 to 3 times as large as a thickness of the paper sheets before recorded. In this respect, this construction is considerably effective.

The U-turn roller 41, the third transporting roller 42 and the discharge unit 43 are each constructed with the roller train each including the transporting rollers and the spur rollers. The roller train may be constructed with one transporting roller and a plurality of spur rollers.

The third transporting roller 42 and the discharge unit 43 are substantially linearly arranged from the last roller train 41*d* of the U-turn roller 41. Those may be located at desired positions if the transporting path is disposed surrounding the transporting path of the carriage 19 and main mechanical parts. For example, the discharge unit 43 may be located at a position lower than the third transporting roller 42 as viewed in the direction A.

The recording sheets P are picked up sheet by sheet from the sheet feeding cassette 10, which is loaded in the depth direction of the device body (depth direction C) from the front surface 14*a* of the device body 14, and the transportation of the recording sheet P starts. The transporting direction of the recording sheet P is the width direction (width direction B) of the device body 14, and more exactly a direction toward a side (to the right in this instance) when viewing the front surface 14*a* of the device body 14.

The recording sheet P of which the transportation is started by the pickup roller 30, is transported further to a side (right in this instance) by the first transporting roller 24. In the first embodiment, the first transporting roller 24 is disposed so that the recording sheet P has a vector directed downward with respect to a horizontal plane (B-C plane) Accordingly, the recording sheet P is transported somewhat downward (to the lower left, here). In the instant embodiment, however, it is straightforwardly transported in the direction as it is The recording sheet P having passed the first transporting roller 24 is further transported forward by the second transporting roller 44. The recording sheet P having passed the second transporting roller 44 is led to a position where it is confronted with the recording head 18. At this position, an image is recorded on the recording sheet by ink ejected from the recording head 18. Thereafter, of those recording sheets P, the ones having images recorded thereon are successively led to the U-turn roller 41.

By the U-turn roller 25, the recording sheet P is transported along the roller trains 41*a* to 41*d* and its advancing direction is changed by about 180°. Specifically, the recording sheet moving to a side (left, here) when viewed form the front surface 14*a* of the device body 14 moves to an opposite side (right, here) when viewed from the front surface 14*a* of the device body 14, after it passed the U-turn roller 41.

At this time, the recording sheet P is passed so as to surround the scanning region of the carriage 19. In other words, the transporting path of the recording sheet P is provided so as to surround the recording head 18 or a region where the recording head 18 records an image on the recording sheet P. In addition, the recording surface of the recording sheet P on which ink is stuck is directed toward the inner side (carriage 19 side). The recording surface comes in contact with the spur rollers; which are located on the inner side of the U-turn roller 41 (the recording head 18 or carriage 19 side) . This feature will prevent deterioration of the image quality of the image recorded on the recording surface of the recording sheet P.

The recording sheet P having passed the U-turn roller 41 is transported further to a side (right, here) by the third transporting roller 42, and is then discharged onto the sheet discharge tray 11 by the discharging unit 43. The user directly accesses the sheet discharge tray 11 from the front of the recording device and takes out the already recorded recording sheet P. A supporting unit for the recording sheet P such as paper guides is provided (not shown) among the transporting roller 42, 44 constituting the transporting path, U-turn roller 41 and the discharge unit 43.

As described above, the recording sheets having been processed for image recording by the recording head 18 are successively led to the U-turn roller 41. That is, the U-turn roller 41 is provided at a downstream side of the recording head 18 with respect to the recording sheet transporting direction of the transporting path. The U-turn roller changes their directions by about 180° (in other words, after recording operation of an image on the recording sheet by the recording head 18 is completed, the transporting direction is changed by the U-turn roller 41). Accordingly, a distance from the recording head 18 to the sheet discharge tray 11 along the transporting path is increased (in other words, the transporting path after the recording operation ends is elongated) when comparing with a case where the recording operation is performed after its U-turn. As a result, a time taken for the start of recording operation till the recording sheet reaches the sheet discharge tray 11 can be increased. As the recording speed is higher, this feature is more effective for problem of recording surface soiling, in particular for a case where a kind of ink (e.g., pigment) having a long drying time is used.

Further, it is noted that the recording surface is faced downward on the sheet discharge tray 11. With this feature, even if ink unintentionally drops to the recording sheet at the time of replacing the ink cartridge 12, there is no chance that the recording surface is soiled, and the feature prevents foreign materials from attaching to the recording surface.

Further, it is noted that the recording head 18 or a region where the recording head 18 records an image on the recording sheet P or the scanning region of the carriage 19 is surrounded by the transporting path for the recording sheet P. Heat generated by parts mounted on the recording head 18 and the carriage 19 quickly dries ink ejected onto the recording sheet P. Further, the recording surface of the recording sheet P onto which ink sticks is directed toward the inner side (the carriage 19 side). This feature minimizes a chance that after the recording operation, the transporting roller comes in contact with it. Accordingly, deterioration of the recording quantity is prevented, and further an air current generated with the scanning motion of the carriage 19 hits the recording surface of the recording sheet P for a long time ranging from the U-turn to the sheet discharging. The air current quickens the drying of ink on the recording surface.

In the ink-jet recording device thus constructed, main mechanical portions of the recording device, such as the carriage 19 and the maintenance unit 40, are located between the sheet feeding cassette 10 an the sheet discharge tray 11 (may be considered as the recording medium supplied and the recording medium discharged) as viewed in the height direction (direction A) of the device body 14. Accordingly, a radius of curvature of the recording medium when it is transported may be set at a maximum value of it, and hence, the size and thickness reduction of the device body is realized. This fact implies that the recorded recording sheet P pass above the recording head 18 or a region where the recording head 18 records an image on the recording sheet P or the carriage 19 as viewed in the direction A. Accordingly, a height of stacked discharged recording sheets may be increased as viewed in the height direction A of the device body 14. As a result, the number of recorded recording sheets P to be stacked maybe increased. It is prevented that a lubricant, such as grease, attached to the mechanical parts attaches to the recorded recording sheets P. therefore, excellent recording quantity is maintained for a long term.

Further, in this embodiment, the pickup roller 30 picks up the recording surface of the recording sheet P. Therefore, a surface of the recording sheet which comes in contact with the lower transporting roller 24*a* of the first transporting roller 24 having a function of a separation member is not the recording surface. With this, there is no chance that the recording surface is damaged through the separation operation.

Further, the recording operation by the recording head 18 is performed before the transporting direction is greatly changed by the U-turn roller 41. Accordingly, a distance from the pickup roller 30 to the recording surface of the recording head 18 is shorter than that in the case where the recording operation follows the U-turn. Accordingly, when at the completion of recording, the next paper sheet is picked up, a distance from the trailing end of the preceding sheet to the leading end of the sheet picked up anew is shortened. As a result, the recording efficiency is improved, and in recording on a plurality of recording sheets, the whole recording time is reduced.

Embodiment 3

Figure 12:
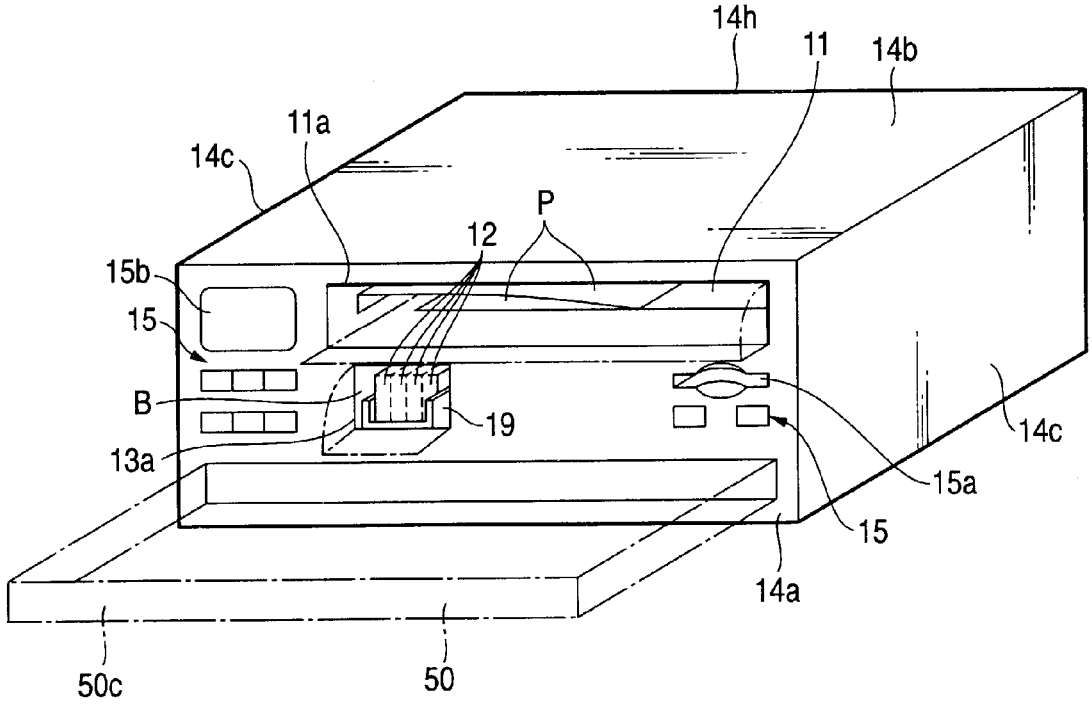
FIG. 12 is a front view perspectively showing an outward appearance of an ink-jet recording device according to a third embodiment of the invention.
Figure 13:
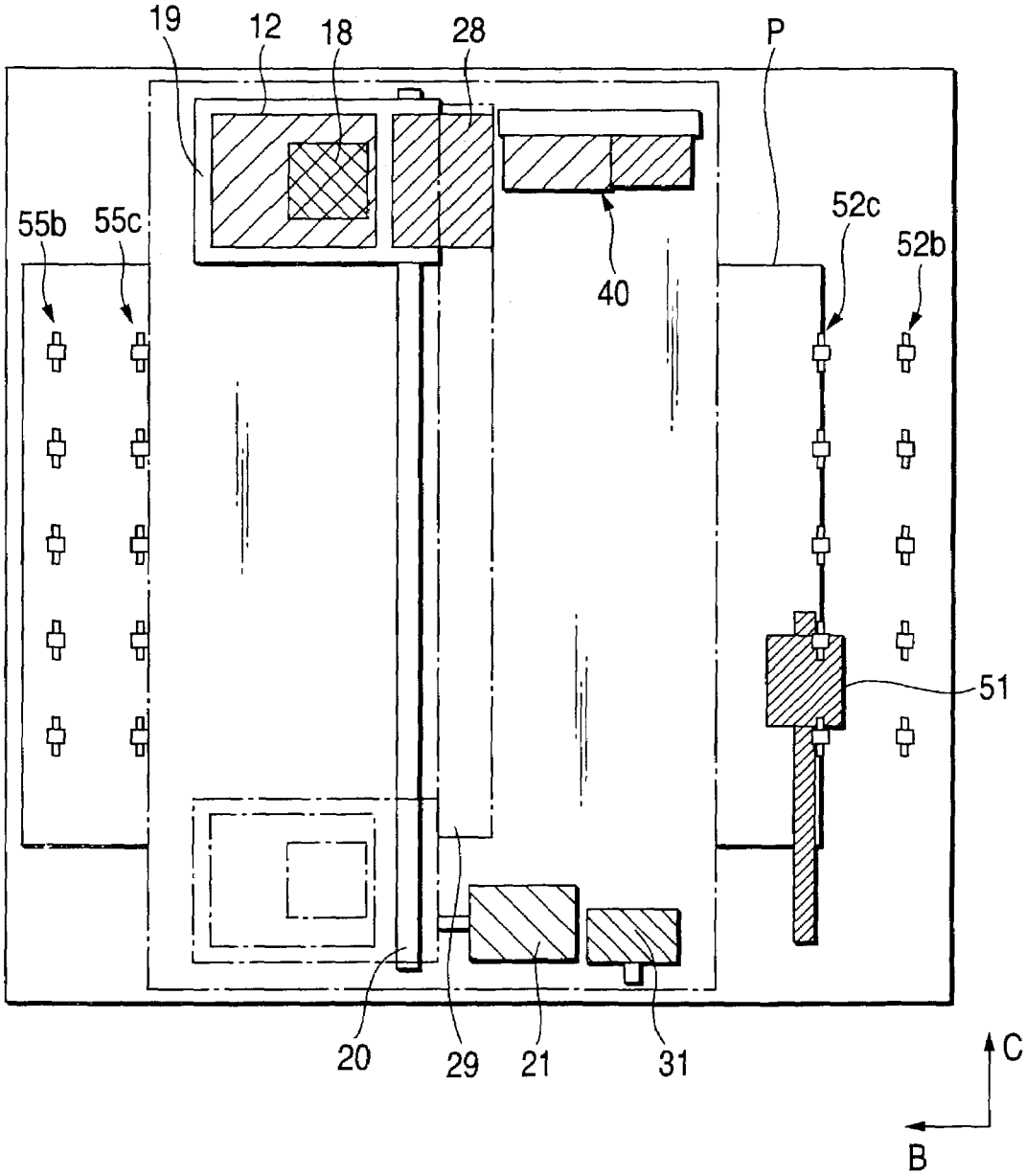
FIG. 13 is a plan view showing a major construction of the ink-jet recording device shown in FIG. 12.
Figure 14:
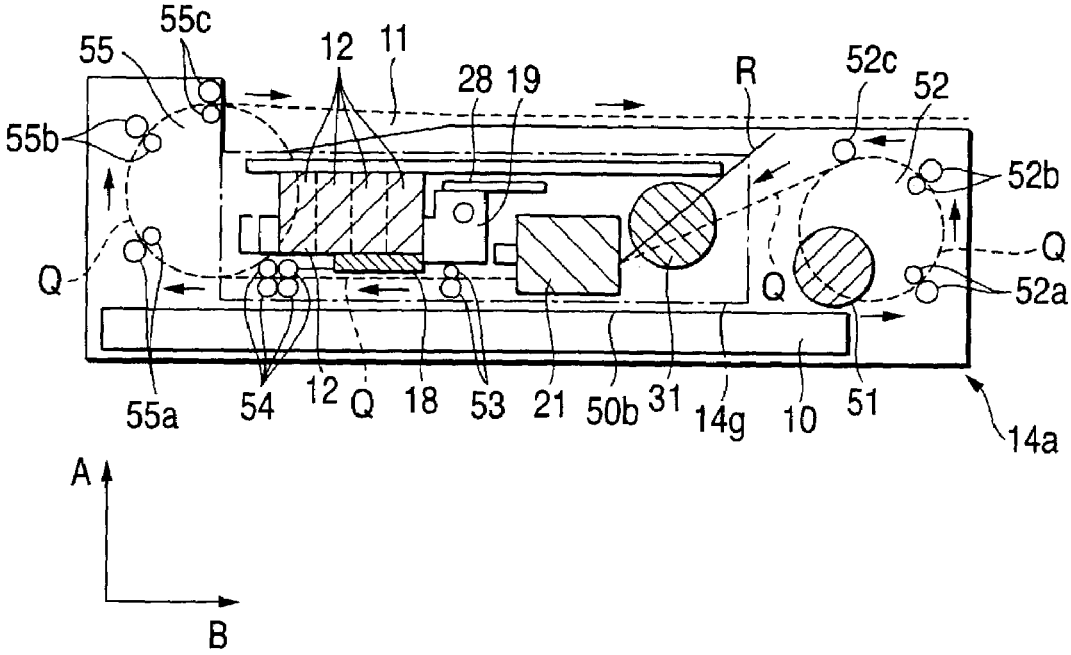
FIG. 14 is a front view showing a major construction of the ink-jet recording device shown in FIG. 12.
Figure 15:
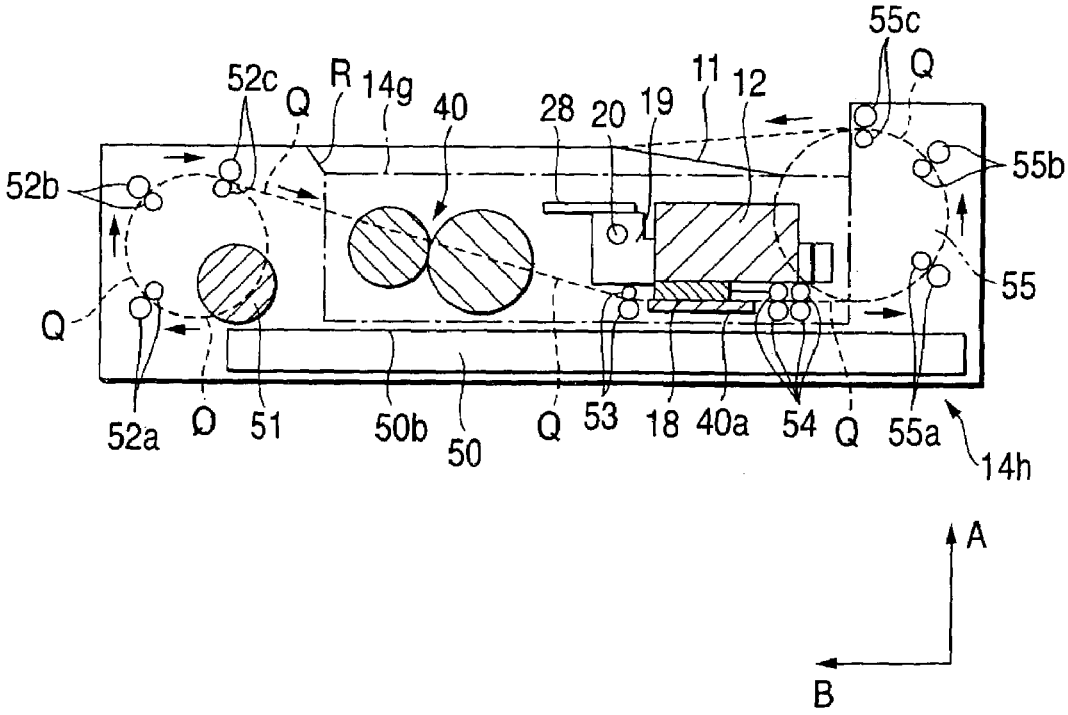
FIG. 15 is a rear view showing a major construction of the ink-jet recording device shown in FIG. 12.
Figure 16:
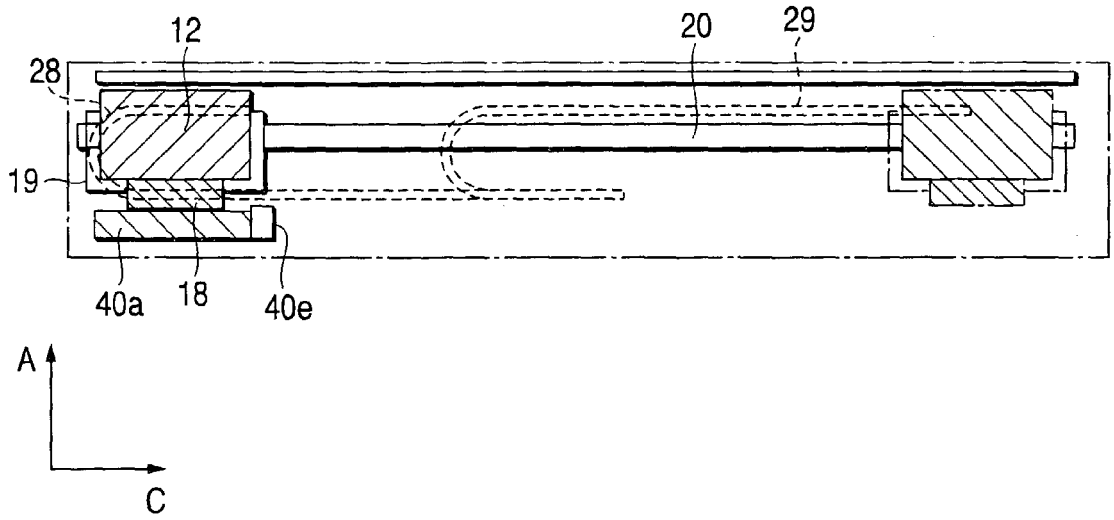
FIG. 16 is a left-side view showing a major construction of the ink-jet recording device shown in FIG. 12.

FIG. 12 is a front view perspectively showing an outward appearance of an ink-jet recording device according to a third embodiment of the invention. FIG. 13 is a plan view showing a major construction of the ink-jet recording device shown in FIG. 12. FIG. 14 is a front view showing a major construction of the ink-jet recording device shown in FIG. 12. FIG. 15 is a rear view showing a major construction of the ink-jet recording device shown in FIG. 12. FIG. 16 is a left-side view showing a major construction of the ink-jet recording device shown in FIG. 12.

The instant embodiment is different from the first and second embodiments in the transporting path for the recording medium. For constructions of the instant embodiment which are substantially the same as of the first and second embodiments, no description will be given, while designating related portions by same reference numerals.

Firstly, a construction of the sheet feeding cassette 50 is different from that of the sheet feeding cassette 10 in each of the first and second embodiments. The sheet feeding cassette 10 in the first and second embodiments includes the pickup roller 30 and the first transporting roller 24. In the sheet feeding cassette 50 of the third embodiment, those components are located at fixed parts in the device body 14 but not in the sheet feeding cassette. A construction of the sheet feeding cassette 50 except the pickup roller and the first transporting roller is substantially the same as of the sheet feeding cassette 10 shown in FIG. 6. The concept of disposing the recording sheets P is also substantially the same as that of the above-mentioned embodiment. No further description of it will be given. Reference numeral 10 designating the sheet feeding cassette is replaced with 50.

The pickup roller 51 is provided at a fixed part of the device body 14, and is disposed facing the pickup surface 50*b* of the recording sheets P stacked on the sheet feeding cassette 50 loaded in the device body 14. A construction of the pickup roller 51 is substantially the same as that of the pickup roller 30 in each of the first and second embodiments except that the pickup roller 51 is located on the device body 14 side.

A first U-turn roller 52 (for changing a transporting direction of the recording medium so as to invert a main component of a vector representing a transporting direction of the recording medium), like the U-turn roller 41 in the second embodiment, includes roller trains 52*a*, 52*b* and 52*c* each consisting of a combination of transport rollers and spur rollers, each roller being small in diameter. The transporting rollers are disposed outside of the transporting path Q, and the spur rollers are disposed inside the transporting path Q. At this stage, the recording process on the recording sheet P is not yet carried out. Accordingly, use of the spur roller is not essential, and it maybe replaced with the transporting roller.

The first transport unit 53, like the second transporting roller 26 in the first embodiment, includes a main roller for determining a transportation accuracy of the recording sheet P, and an encoder for measuring a rotation accuracy, both being on the same shaft.

A first transport unit 54 transports the recording sheet P after the recording sheet P receives ink ejected from the recording head 18. Accordingly, the first transport unit 54 includes two roller trains each consisting of spur rollers located on the recording surface side and transporting rollers located on the side opposite to the recording surface side. The first transport unit 54 serves as sheet discharging unit in the case of common use of mechanical parts to be given later. For this reason, two roller trains are used. Where the common use is not considered, use of one roller train suffices.

A second U-turn roller 55 (for changing a transporting direction of the recording medium so as to invert again a main component of a vector representing a transporting direction of the recording medium), like the U-turn roller 41 in the second embodiment, also includes roller trains 55*a*, 55*b* and 55*c* each consisting of a combination of transport rollers spur rollers, each roller being small in diameter. The transporting rollers are disposed outside of the transporting path Q, and the spur rollers are disposed inside the transporting path Q. The recording surface of the recording sheet P on which ink is ejected moves while facing the inner side (i.e., the spur roller side), so that the recording surface is hardly soiled. The final roller train 55*c* of the second U-turn roller 55 serves as sheet discharging unit.

Next, operations of the transporting system in the ink-jet recording device thus constructed will be described.

The pickup roller 51 is brought into contact with the pickup surface 50*b* of the sheet feeding cassette 50 in which recording sheets P are set, and the pickup roller 51 picks up one recording sheet P and the transportation of the recording sheet P starts. At this time, the transporting direction of the recording sheet P is the width direction (direction B) of the device body 14. More specifically, it is transported to a side (right side, here) when viewing the front surface 14a of the device body 14. The picked up recording sheet P advances to another side (right side, here) when viewed from the front surface 14*a* of the device body 14, and is led to the roller train 52*a* located closest to the pickup roller 51, and then passes the roller trains 52*b* and 52*c*. The roller train 52*c* is disposed so as to cause a vector directed downward with respect to the horizontal plane (B-C plane) in the recording sheet P. The advancing direction of the recording sheet P is changed by 180° or larger, and the recording sheet advances to the side opposite to the side in its previous traveling and somewhat downward (lower left, here). The recording sheet P advances along a paper guide (not shown), and is led to the first transport unit 53. And, the recording sheet P changes its traveling direction to an almost horizontal direction with the aid of the first transport unit 53, and then is led to a surface facing the recording head 18. The recording sheet P on which a given image is recorded by ink ejected from the recording head 18 is led further to the side by the first transport unit 54, and then to the roller train 55*a* of the second U-turn roller 55, located closest to the recording head 18. When the recording sheet passes the roller trains 52*b* and 52*c*, the recording sheet P changes its advancing direction by about 180°, and moves to the side (right side, here) opposite to that in its previous traveling, viz., its direction is changed to the advancing direction substantially the same as when it is picked up, and in this direction, the recording sheet travels. Finally, the recording sheet is discharged onto the sheet discharge tray 11 by the roller train 55*c* also serving as the final discharging unit. The user directly accesses the sheet discharge tray 11 from the front surface 14*a*, and takes out the recording sheet P of which recording process is completed. A guide member (not shown) for guiding the recording medium is preferably provided between the members forming the transporting system.

Characteristic construction features of the embodiment will be described.

Since the first U-turn roller 52 and the second U-turn roller 55 are used, a length of the device body 14 in the width direction B is reduced. Accordingly, a radius of curvature of the recording sheet P to be transported may be set at a large value to thereby suppressing paper jamming occurrence.

Also in the embodiment, the first U-turn roller 52 and the second U-turn roller 55 are disposed at positions closer to both ends of the device body 14 when viewed from the front surface 14*a*. A recording block 14*g* including the recording head 18 or the scanning region of the carriage 19 is disposed at the central part. Specifically, the plurality of U-turn roller surround (in other words, the recording head 18 or the recording block 14*g* is located between the first U-turn roller 52 and the second U-turn roller 55) the recording head 18 or the region where the recording on the recording medium is carried out by the recording head 18 or the recording block 14*g* including the scanning region of the carriage 19 in the horizontal direction (B-C plane direction) (the maintenance unit 40 may be included, as a matter of course.) . With such a construction, the first U-turn roller 52 and the second U-turn roller 55 may have each a large radius of curvature, therefore, even though a recording sheet such as a thick paper easy to be jammed is passed through, each of the U-turn unit allows the recording sheet to pass there through with less chance of jamming occurrence. The resultant ink-jet recording device has a high reliability.

If a radius of curvature of the second U-turn roller 55 is selected to be larger than that of the first U-turn roller 52, the jamming occurrence is made infrequent at the second U-turn roller 55 through which the recorded sheet is to be passed which must be carefully transported, and of which ink not yet dried will soil its vicinal pats highly possibly when paper jamming occurs. This feature is fairly preferable in the ink-jet recording device.

The second U-turn roller 55 is disposed above the sheet feeding cassette 10. Accordingly, the length of the device body 14 in the width direction B is reduced. The resultant ink-jet recording device is suitable for use with the cabinet.

The recording block 14*g* is designed to be operable as an ink-jet recording device if the sheet feeding cassette 50, the U-turn rollers 52 and 55 and the sheet discharge tray 11 are removed. A transporting path in such a case is indicated by a solid line R in FIG. 14. Only providing a paper guide along the solid line R realizes the transporting path indicated by the solid line R. The first transport unit 54 is provided with a plurality of roller trains so as to have a function of the discharging unit.

When the ink-jet recording device based on the recording block 14*g* is disposed in a state that the sheet feeding side indicated by the solid line R is located on the rear side of the device, it functions as an ink-jet recording device of the type in which the recording sheet is inserted from the rear side, and discharged from the front side.

Thus, by combining one recording block 14*g* with peripheral devices, an ink-jet recording device of the front operation type may be constructed, and also an ink-jet recording device of the type for use with a personal computer where the recording medium is transported from the rear side to the front side may be constructed. Accordingly, the recording block 14*g* may be used commonly by different types of ink-jet recording devices. This feature increases a variation of the ink-jet recording devices, and reduces the cost to manufacture.

In the height direction (direction A) of the device body 14, the recording block 14*g* is disposed between the sheet feeding cassette 50 and the sheet discharge tray 11 (in other words, the recording head 18 or the recording block 14*g* is located between the sheet feeding cassette 50 and the sheet discharge tray 11). By so disposing, the medium feed portion which must be inserted and drawn out from the outside (front surface 14*a*) of the device body 14, the medium discharge portion, ink feed portion, and ink supplying body loading portion may be stacked in the height direction (direction A) of the device body. This leads to size reduction of the device body in the width direction. The user inserts and draws out the recording sheet and the cartridge and takes out the recorded recording sheet, in a simple manner. Accordingly, an ink-jet recording device having good operability is provided.

The recording block 14*g* is located at the central part of the device body 14. Accordingly, the recording sheet P is smoothly transported, and further a chance that the recorded recording sheet P is soiled with ink when ink replacing work is lessened.

The sheet discharge tray 11 is located at a position higher than the cartridge loading portion 13 to and from which the ink cartridges 12 is inserted and drawn out in the height direction (direction A) of the device body 14 (viz., the recording sheet P is located at a position higher than the carriage 19, the recording head 18 mounted on the carriage 19, and the ink cartridges 12). Accordingly, there is no chance that at the time of replacing the ink cartridge 12, ink unintentionally drops to the recorded recording sheet as discharged onto the sheet discharge tray 11.

The recording sheets having been processed for image recording by the recording head 18 are successively led to the U-turn roller 41. The U-turn roller changes their directions by about 180°. Accordingly, a distance from the recording head 18 to the sheet discharge tray 11 along the transporting path is increased when comparing with a case where the recording operation is performed after its U-turn. As a result, a time taken for the start of recording operation till the recording sheet reaches the sheet discharge tray 11 is increased. As the recording speed is higher, this feature is more effective for problem of recording surface soiling, in particular for a case where a kind of ink (e.g., pigment) having a long drying time is used. Further, it is noted that the recording surface is faced downward on the sheet discharge tray 11. With this feature, even if ink unintentionally drops to the recording sheet at the time of replacing the ink cartridge 12, there is no chance that the recording surface is soiled, and the feature prevents foreign materials from attaching to the recording surface.

Embodiment 4

Figure 18:
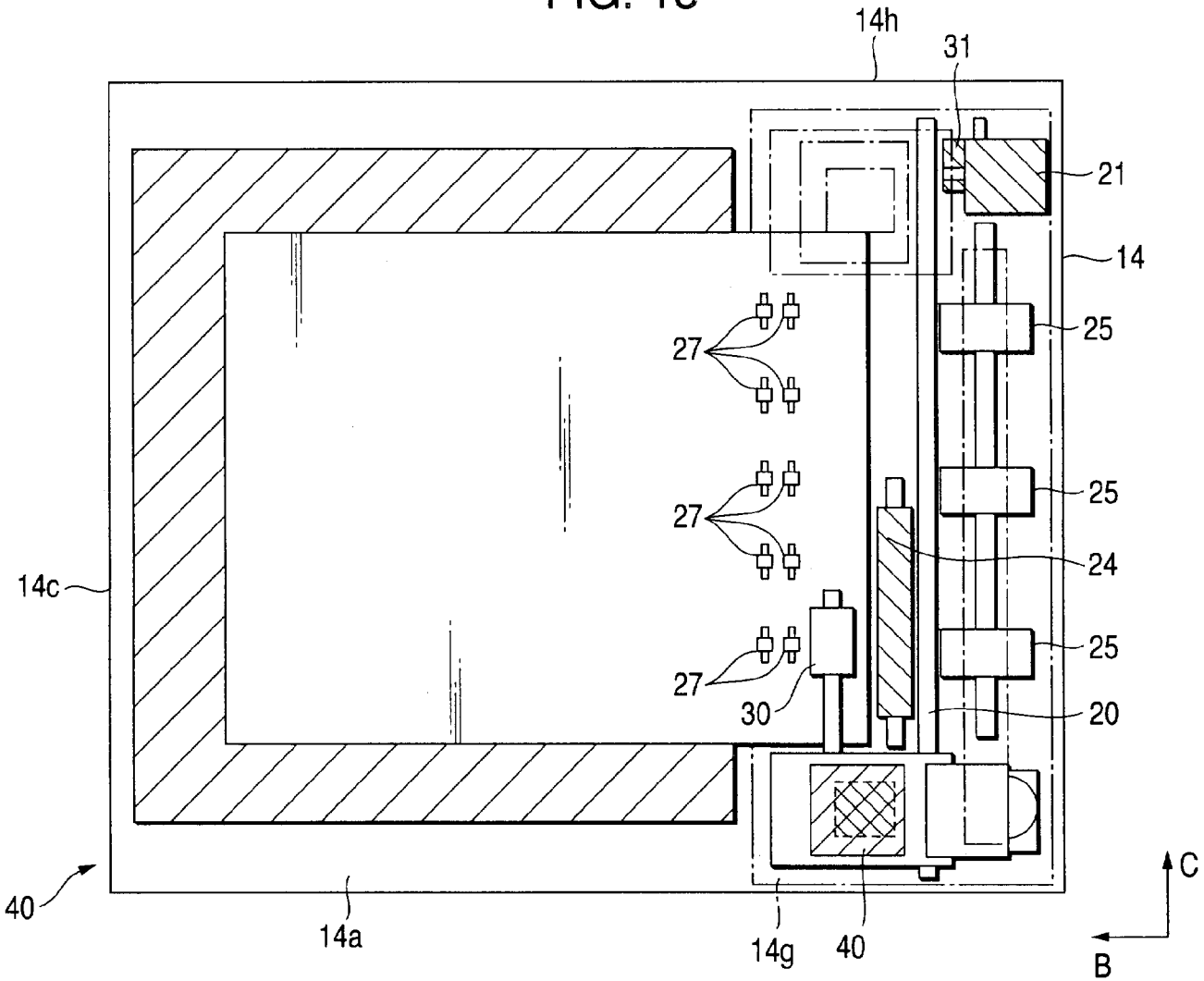
FIG. 18 is a plan view showing a major construction of an ink-jet recording device, which is a fourth embodiment of the invention.
Figure 19:
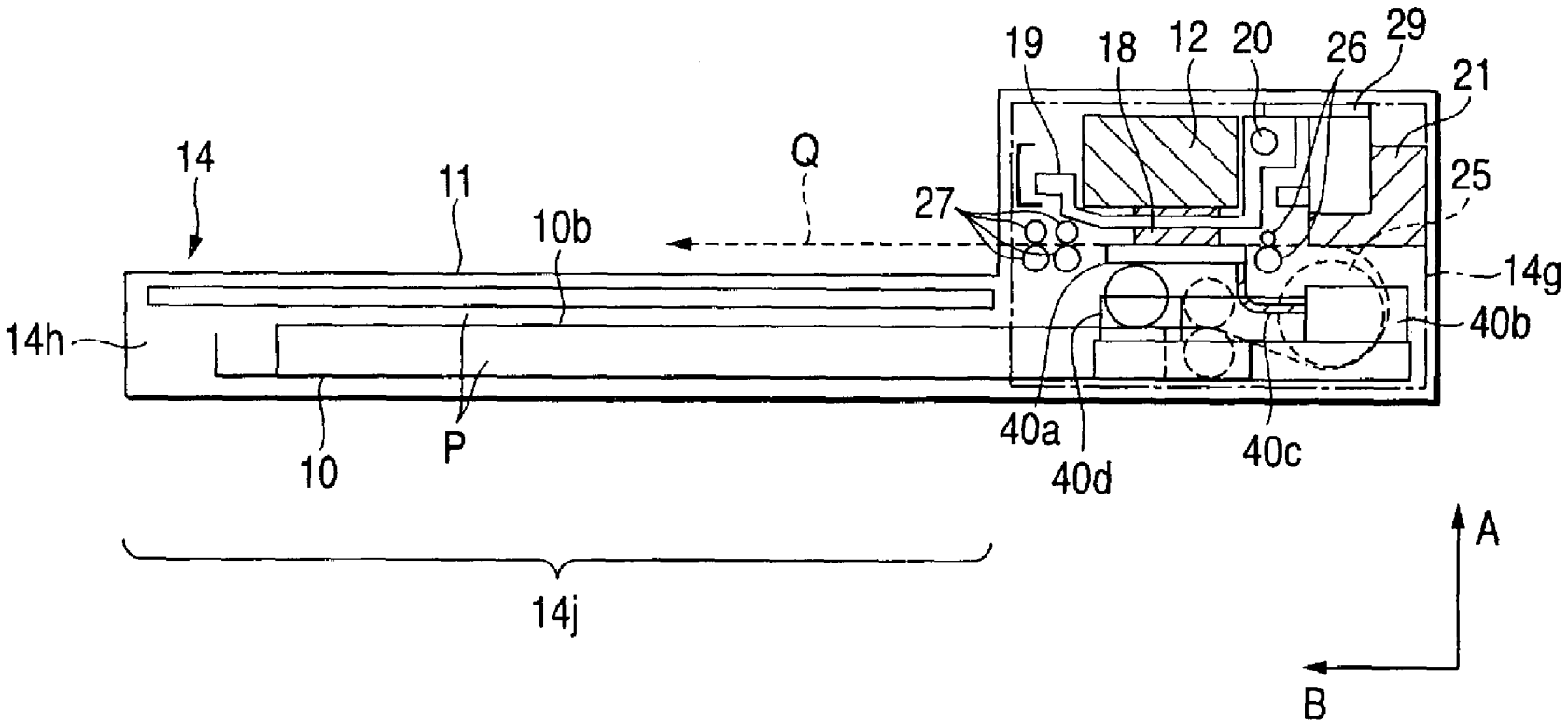
FIG. 19 is a front view showing a major construction of an ink-jet recording device as the fourth embodiment of the invention.
Figure 20:
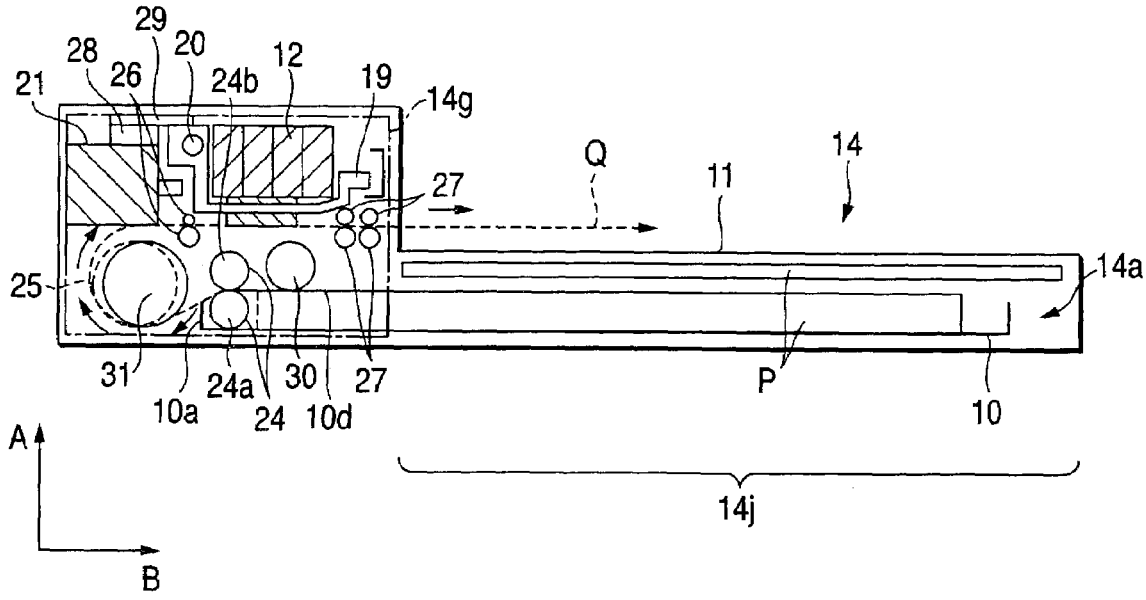
FIG. 20 is a rear view showing a major construction of an ink-jet recording device as the fourth embodiment of the invention.
Figure 21:
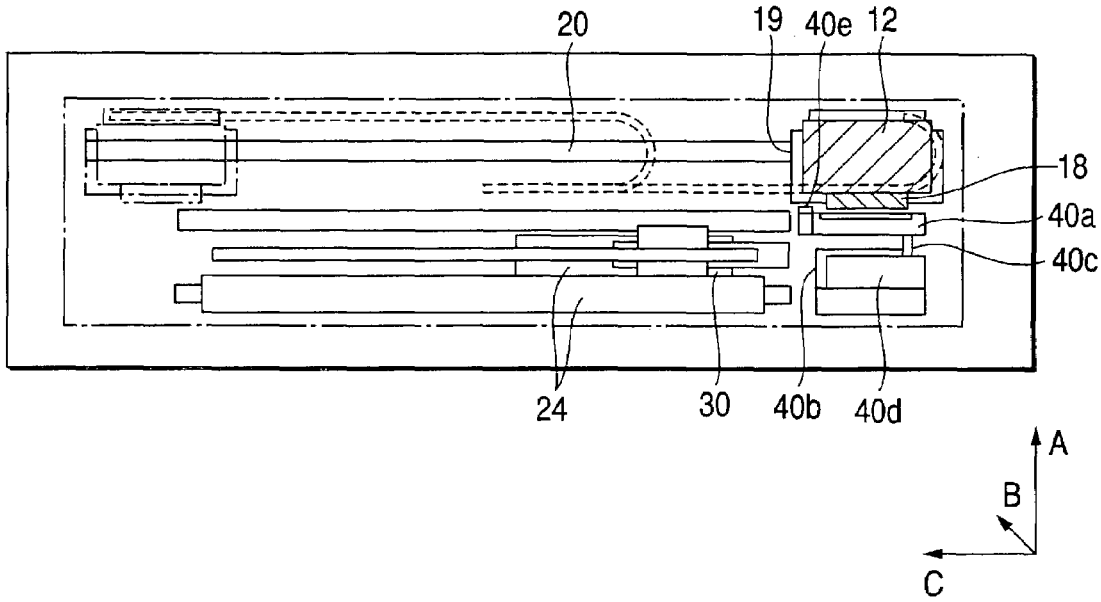
FIG. 21 is a left-side view showing a major construction of an ink-jet recording device as the fourth embodiment of the invention.

FIG. 18 is a plan view showing a major construction of an ink-jet recording device according to a fourth embodiment of the invention. FIG. 19 is a front view showing a major construction of an ink-jet recording device as the fourth embodiment of the invention. FIG. 20 is a rear view showing a major construction of an ink-jet recording device as the fourth embodiment of the invention. FIG. 21 is a left-side view showing a major construction of an ink-jet recording device as the fourth embodiment of the invention.

An outward appearance of the ink-jet recording device of the fourth embodiment is similar to that of the first embodiment shown in FIG. 1. A construction of the interior of the device body is also substantially the same as the first embodiment except that a layout of the maintenance unit. Accordingly, similar to or equivalent portions are designated by like reference numerals, and description other portions than the maintenance unit will be omitted.

In the fourth embodiment, a maintenance unit 400, unlike the maintenance unit 40 of the first embodiment, is disposed on the front surface 14*a* side of the device body 14.

Specifically, when the carriage 19 which reciprocatively moves between the end of the back surface 14*h* side and the end of the front surface 14*a* is on the front surface 14*a* side, the cap part 4*a*, the wiping member 40*e* and the like of the maintenance unit 40 are confronted with the recording head 18.

With such a construction, the region for replacing the ink cartridges 12 and the region for the maintenance operation of the recording head 18 are located at the same end part of the front surface 14*a* side of the device body 14. Accordingly, when comparing with a case where those regions are located at different end thereof, a restoring operation of a necessary recording head 18 can be quickly performed immediately after the replacement of the ink cartridge 12.

In a case where as in the instant embodiment, the scanning direction of the carriage 19 and the inserting/drawing-out direction of the sheet feeding cassette 10 (the inserting/drawing-out direction of the recording sheet P to the medium feed portion) are the depth direction (direction C) of the device body, when the maintenance unit 40 is located on the front surface 14*a* side of the device body 14 through which the sheet feeding cassette 10 is inserted and drawn out, its spatial interference with the sheet feeding cassette 10 must be avoided.

To solve problem proper to the ink-jet recording device of the type in which the scanning direction of the carriage and the inserting/drawing-out direction of the recording sheet are the same, a space through which the recording sheet P (sheet feeding cassette 10) is inserted and drawn out at least partially overlaps with the cap part 40*a* and the wiping member 40*e* in the height direction A. Further, the pump part 40*b* and the motor part 40*d* of the maintenance unit 40 at least partially overlap with the space through which the recording sheet P (sheet feeding cassette 10) is inserted and drawn out, in the width direction B.

With such a construction, the sheet feeding cassette 10 never spatially interferes with the maintenance unit 40, and size increase of the device body 14 is prevented. In particular, restrictions on the width direction B and the height direction A of the device are minimized. The recording device may easily be placed within a limited space of a housing body, such as a cabinet. An ink-jet recording device which is excellent in space saving is realized.

When the ink cartridges 12 mounted on the carriage 19 are removed from the front surface 14*a*, it is preferable that the cap part 40*a* of the maintenance unit 40 is in contact with the recording surface of the recording head 18 or that even when those are put in a separated state, it is located just under the recording head 18. If so done, even when a pressure within the recording head 18 varies at the time of replacement of the ink cartridges 12, and ink leaks out of the nozzle of the recording head 18, there is less chance that the sheet feeding cassette 10 and the recording sheets P, located thereunder are soiled with ink.

As seen from the foregoing description, the ends of recorded recording media are located at positions substantially equidistantly separated from the device body, while being flush with the latter. Accordingly, the invention succeeds in providing an ink-jet recording device which has good use convenience and enables the user to easily take out discharged recording medium.

A region for replacing an ink supplying body and a maintenance operation region for a recording head are both located on an end part of a predetermined surface of the sheet feeding cassette. When comparing with a case where those regions are located at different end parts thereof, a restoring operation of a necessary recording head is quickly performed immediately after the replacement of the ink supplying body.

In another feature of the invention, a bottom of a U-turn roller is located at a position which is lower than pickup roller as viewed in the height direction of the device. With this feature, size reduction of the device body, in particular reduction of a height of the device body, is realized, while effectively utilizing a dead space within the device body.

Further, the recording medium is successively transported from a region where the recording operation by the recording head ends to the U-turn roller. Accordingly, a transporting path along which the recording medium will travel after the recording operation ends is elongated, so that a time taken for the recording medium to travel from the transporting path till the recording medium is discharged is reduced.

In the invention, the discharging unit is located at a position higher than the recording head with respect the height direction of the device body. A sheet discharging position is set at a higher position with respect to the height direction of the device body. The number of recorded recording media to be stacked is increased.

Further, the recording head is located at a position between the medium feed portion and the medium discharge portion as viewed in the height direction of the device body. Accordingly, a radius of curvature of the recording medium when it is transported may be set at a maximum value of it, and hence, the size and thickness reduction of the device body is realized.

What is claimed is:

1. An ink-jet recording device comprising:

a medium feed portion for feeding recording media;

a transporting system for transporting a recording medium from said medium feed portion, said transporting system including a pickup member for picking up a recording medium placed in said medium feed portion and a direction-inverting roller, which inverts a transporting direction of the recording medium to invert a main component of a vector representing a transporting direction of the recording medium picked up by said pickup member, and a transporting member for transporting the recording medium picked up by said pickup member to said direction-inverting roller;

a medium discharge portion to which recorded recording medium transported by said transporting system is discharged; and a recording head for ejecting ink toward a recording medium, wherein a bottom of said direction-inverting roller is located at a position lower than a pickup surface of said pickup member at which said pickup member picks up the recording medium, with respect to a height direction;

wherein the recording medium is inserted and drawn out in a horizontal direction with respect to a mounting surface on which the ink-jet recording device is mounted, and wherein said media feed portion is a cassette and at least a part of the transporting member is placed in the cassette.

2. The ink-jet recording device according to claim 1, wherein said pickup member includes a roller, and a bottom of said roller is located at a position higher than a bottom of said direction-inverting roller with respect to the height direction of said device.

3. The ink-jet recording device according to claim 1, wherein said transporting member includes a transporting roller, and a bottom of said transporting roller is located at a position higher than a bottom of said direction-inverting roller with respect to the height direction of said device.

4. The ink-jet recording device according to claim 1, wherein the recording medium is inserted into and drawn-out of a device body in a first direction, and the recorded recording medium is drawn out of said medium discharge portion in the first direction, and the recording medium in said transporting system is transported in a second direction different from the first direction.

5. The ink-jet recording device according to claim 1, wherein said medium discharging portion is located at a position higher than said recording head with respect to the height direction of said device.

6. The ink-jet recording device according to claim 1, further comprising an ink supplying body for supplying the ink to said recording head;

a carriage for mounting said recording head and said ink supplying body, wherein said medium discharging portion is located at a position higher than said ink supplying body with respect to the height direction of said device.

7. The ink-jet recording device according to claim 1, further comprising:

a carriage for mounting said recording head and performs a reciprocating movement in a first direction;

a maintenance unit comprising: a cap member located at a position opposed to said carriage, for restricting the drying of nozzles of said recording head; a wiping member for wiping out a nozzle face of said recording head; and a pump disposed at a position lower than said recording head with respect to the height direction, for sucking ink from said recording head; and an operation section provided on a first plane of a device body, wherein the recording medium is inserted into and drawn out of the device body in the first direction from the first plane, wherein the recorded recording medium is drawn out of said medium discharge portion in the first direction from the first plane, wherein the recording medium in said transporting system is transported in a second direction perpendicular to the first direction, wherein said maintenance unit is confronted with said recording head at an end of a reciprocatively moving region of said carriage, and the end is located closer to the first plane.

8. The ink-jet recording device according to claim 1, further comprising:

a carriage for mounting said recording head and performs a reciprocating movement in a first direction; and an operation section provided on a first plane of a device body, wherein the recording medium is inserted into and drawn out of the device body in the first direction from the first plane, wherein the recorded recording medium is drawn out of said medium discharge portion in the first direction from the first plane, wherein the recording medium in said transporting system is transported in a second direction perpendicular to the first direction, wherein at least a part of said medium feed portion is overlapped with at least a part of said carriage with respect to the transporting direction of the recording medium.

9. The ink-jet recording device according to claim 1, further comprising:

a carriage for mounting said recording head, wherein said medium discharging portion is located at a position higher than said carriage with respect to the height direction of said device.

10. The ink-jet recording device according to claim 1, further comprising:

a carriage for mounting said recording head and performs a reciprocating movement in a first direction;

a plurality of ink supplying bodies arranged along a first plane, each of said ink supplying bodies storing ink supplied to said recording head and attached to and detached from said carriage from a first plane; and an ink supplying body loading portion in which a space ranging from an opening formed in the first plane of a device body to the interior of said ink-jet recording device;

wherein said ink supplying body is inserted into and drawn out of said ink supplying body loading portion in the first direction, wherein the recording medium is inserted into and drawn out of the device body in the first direction from the first plane, wherein the recorded recording medium is drawn out of said medium discharge portion in the first direction from the first plane, wherein the recording medium in said transporting system is transported in a second direction different from the first direction, wherein said medium feed portion includes a reference position of the recording media therein at a side of the first plane with respect to the center of said medium feed portion.

11. An ink-jet recording device comprising:

a medium feed portion f or feeding recording media;

a transporting system for transporting a recording medium from said medium feed portion, said transporting system including a pickup member for picking up a recording medium placed in said medium feed portion, and a direction-inverting roller, which inverts a transporting direction of the recording medium so as to invert a main component of a vector representing a transporting direction of the recording medium picked up by said pickup member, and a transporting member for transporting the recording medium picked up by said pickup member to said direction-inverting roller;

a medium discharge portion to which recorded recording medium transported by said transporting system is discharged; and a recording head for ejecting ink toward a recording medium, wherein the recording medium has a vector directed downward when the recording medium is transported from the pickup member to the direction-inverting roller;

wherein the recording medium is inserted and drawn out in a horizontal direction with respect to a mounting surface on which the ink-jet recording device is mounted, and wherein said media feed portion is a cassette and at least a part of the transporting member is placed in the cassette.

12. An ink-jet recording device comprising:

a medium feed portion for feeding recording media;

a transporting system for transporting a recording medium from said medium feed portion, said transporting system including a pickup member for picking up a recording medium placed in said medium feed portion and a direction changing member for changing a transporting direction of the recording medium to invert a main component of a vector representing a transporting direction of the recording medium picked up by said pickup member;

a medium discharge portion to which recorded recording medium transported by said transporting system is discharged;

a recording head for ejecting ink toward a recording medium, and;

a carriage for mounting said recording head, wherein a bottom of said direction changing member is located at a position lower than said pickup member with respect to a height direction;

wherein the recording medium is inserted and drawn out in a horizontal direction with respect to a mounting surface on which the ink-jet recording device is mounted;

wherein said medium discharging portion is located at a position higher than said carriage with respect to the height direction of said device.

13. An ink-jet recording device comprising:

a medium feed portion for feeding recording media;

a transporting system for transporting a recording medium from said medium feed portion, said transporting system including a pickup member for picking up a recording medium placed in said medium feed portion and a direction changing member for changing a transporting direction of the recording medium to invert a main component of a vector representing a transporting direction of the recording medium picked up by said pickup member;

a medium discharge portion to which recorded recording medium transported by said transporting system is discharged;

a recording head for ejecting ink toward a recording medium, a carriage for mounting said recording head and performs a reciprocating movement in a first direction;

a plurality of ink supplying bodies arranged along a first plane, each of said ink supplying bodies storing ink supplied to said recording head and attached to and detached from said carriage from a first plane; and an ink supplying body loading portion in which a space ranging from an opening formed in the first plane of a device body to the interior of said ink-jet recording device;

wherein a bottom of said direction changing member is located at a position lower than said pickup member with respect to a height direction;

wherein the recording medium is inserted and drawn out in a horizontal direction with respect to a mounting surface on which the ink-jet recording device is mounted;

wherein said ink supplying body is inserted into and drawn out of said ink supplying body loading portion in the first direction, wherein the recording medium is inserted into and drawn out of the device body in the first direction from the first plane, wherein the recorded recording medium is drawn out of said medium discharge portion in the first direction from the first plane, wherein the recording medium in said transporting system is transported in a second direction different from the first direction, wherein said medium feed portion includes a reference position of the recording media therein at a side of the first plane with respect to the center of said medium feed portion.

* * * * *